US008678387B2

(12) United States Patent
Taniguchi

(10) Patent No.: US 8,678,387 B2
(45) Date of Patent: Mar. 25, 2014

(54) PAPER-SHEET HANDLING APPARATUS AND PAPER-SHEET HANDLING METHOD

(75) Inventor: Tetsuya Taniguchi, Himeji (JP)

(73) Assignee: Glory Ltd., Himeji-Shi, Hyogo-Ken (JP)

( * ) Notice: Subject to any disclaimer, the term of this patent is extended or adjusted under 35 U.S.C. 154(b) by 43 days.

(21) Appl. No.: 13/432,067

(22) Filed: Mar. 28, 2012

(65) Prior Publication Data

US 2012/0242031 A1 Sep. 27, 2012

Related U.S. Application Data

(63) Continuation-in-part of application No. PCT/JP2009/066795, filed on Sep. 28, 2009.

(51) Int. Cl.
*B65H 5/02* (2006.01)

(52) U.S. Cl.
USPC ..... 271/275; 271/306

(58) Field of Classification Search
USPC ..... 271/3.01, 3.14, 3.21, 275, 198, 306; 414/789.9
See application file for complete search history.

(56) References Cited

U.S. PATENT DOCUMENTS 4,822,018 A * 4/1989 Hain ..... 271/3.2
6,019,209 A * 2/2000 Hara et al. ..... 194/206

FOREIGN PATENT DOCUMENTS

WO WO 96/15511 5/1996
WO WO 2009/034722 A1 3/2009

OTHER PUBLICATIONS

Translation of WO2009034722.*
International Search Report of PCT/JP2009/066795 (1 page—dated Jan. 12, 2010).
International Preliminary Report on Patentability (PCT/JP2009/066795) (7 pages—Date of Mailing Apr. 19, 2012).

* cited by examiner

*Primary Examiner* — Michael McCullough
(74) *Attorney, Agent, or Firm* — Renner, Kenner, Greive, Bobak, Taylor & Weber

(57) ABSTRACT

The control unit 60 controls driving units 45*b*, 45*c* and 45*d* in such a manner that, when the detecting unit 36*b* detects at least the one paper sheet P2, the detected paper sheet P2 and the bundled of paper sheet P1 escrowed in the loop portion are merged to each other, and that the merged paper sheets P1 and P2 are escrowed in the loop portion. At this time, the control unit 60 controls the drive units 45*b*, 45*c* and 45*d* such that, after the detected paper sheet P2 and the escrowed bundle of paper sheet P1 have been merged or partly merged to each other, the merged or partly-merged paper sheets P1 and P2 are accelerated in at least the loop portion.

11 Claims, 10 Drawing Sheets

PAPER-SHEET HANDLING APPARATUS AND PAPER-SHEET HANDLING METHOD

CROSS-REFERENCE TO RELATED APPLICATIONS

This application is a continuation-in-part of International Application No. PCT/JP2009/066795 filed on Sep. 28, 2009. The entire disclosures of the above applications are incorporated herein by reference.

FIELD OF THE INVENTION

The present invention relates to a paper-sheet handling apparatus and a paper-sheet handling method that returns a plurality of paper sheets of different lengths, such as banknotes, checks and so on, such that designated portions (e.g., front end edges, rear end edges and so on) in a transport direction have a predetermined positional relationship.

BACKGROUND OF THE INVENTION

Various kinds of paper-sheet handling systems for storing therein a paper sheet such as a banknote, a check and so on have been conventionally known in general. In such a paper-sheet handling system, a paper sheet is taken to the inside through an inlet opening. When a command for cancelling storing is given by a higher-level apparatus or a user after the paper sheet has been taken to the inside, the paper sheet is generally returned through a return opening.

In a case where a plurality of paper sheets of largely differed lengths are stored by a user into the paper-sheet handling system, after the plurality of paper sheets have been taken to the inside of the apparatus through the inlet opening, when the user or the like gives a command for cancelling storing by pressing down a storing cancel button, for example, it is desirable that the plurality of paper sheets of largely differed lengths are collectively returned in a bundle state through the return opening, upon the storing cancellation. In particular, it is preferable that the plurality of paper sheets of different lengths are returned in a bundle state, with designated portions (e.g., front end edges, rear end edges and so on) in a transport direction being aligned with each other, or that the paper sheets are retuned in a bundle state, with designated portions in the transport direction of adjacent paper sheets being displaced from each other by a predetermined amount.

Patent Document 1 discloses a banknote temporary storage apparatus in which a drum wound by an endless belt is rotated, so that banknotes are escrowed (stored) in a bundle state on the belt. In the banknote temporary storage apparatus shown in Patent Document 1, a rotation speed of the drum is configured to be synchronized with a feeding speed of banknotes. In addition, Patent Document 2 discloses a banknote handling apparatus which uses an endless belt instead of a drum, in order to escrow banknotes in a bundle state. To be more specific, in the banknote handling apparatus shown in Patent Document 2, a bundle of paper sheet(s) is sandwiched between a pair of endless belts so as to be escrowed.

Patent Document 1: JP6-32514A
Patent Document 2: JP6-131530A

DISCLOSURE OF THE INVENTION

In an apparatus as shown in Patent Documents 1 and 2, in which paper sheets such as banknotes, checks and so on are wound on a rotary body so as to make a bundle of paper sheet(s) (a paper-sheet bundle), and the plurality of paper sheets are escrowed in a bundle state, when one transported paper sheet is detected by a sensor or the like, the rotary body, which stops at a waiting position, starts to rotate. Then, under a state in which an outer peripheral speed of the rotary body is in synch with a transport speed of the detected paper sheet, the detected paper sheet is wound on the rotary body.

In such an apparatus, when paper sheets are intermittently transported to the rotary body, or when, as shown in FIG. 15(*a*), paper sheets are transported to a rotary body 90 at a pitch (p) (an interval between one paper sheet and a succeeding paper sheet) which is larger than an outer peripheral length (l) of the rotary body 90, the rotary body 90 can wind the paper sheets, with end portions (front end edges or rear end edges) of the paper sheets being aligned with each other. However, as shown in FIG. 15(*b*), when paper sheets are transported to the rotary body 90 at a pitch (p) which is shorter than the outer peripheral length (l) of the rotary body 90, a succeeding paper sheet reaches a detection position before the rotary body 90 reaches the waiting position. Thus, even when the rotary body 90 is continuously rotated without being stopped, it is impossible to wind the paper sheets in a normal state in which the end portions of the paper sheets are aligned with each other.

Specifically, as shown in FIG. 15(*b*), when paper sheets having different lengths in the transport direction, e.g., banknotes having different shapes depending on denominations, such as euro banknotes, checks having different shapes depending on writers and so on, are transported to the rotary body 90 with a predetermined distance (d) therebetween, there is a case in which the paper sheets are transported to the rotary body 90 at the pitch (p) which is shorter than the outer peripheral length (l) of the rotary body 90. In this case, the paper sheets cannot be wound on the rotary body 90 in a normal state in which end portions of the paper sheets are aligned with each other. In addition, as the number of paper sheets to be wound increases, the outer peripheral length (l) of the rotary body 90 increases. Thus, it is necessary to increase the transport pitch (p) of paper sheets in order to increase a capacity of the apparatus. However, there is a problem in that, when the transport pitch (p) of paper sheets is increased, a paper-sheet handling amount of the apparatus per hour is lowered.

The present invention has been made in view of the above circumstances. The object of the present invention is to provide a paper-sheet handling apparatus and a paper-sheet handling method capable of escrowing paper sheets in a loop portion such that designated portions (e.g., front end edges, rear end edges and so on) of the paper sheets have a predetermined positional relationship, even when the paper sheets have been transported to the loop portion at a pitch shorter than a length of the loop portion.

The present invention is a paper-sheet handling apparatus including: a transport path of a paper sheet, including a loop portion capable of transporting and escrowing a bundle of paper sheet(s); a detecting unit located on the transport path at a position on an upstream side relative to the loop portion, the detecting unit being configured to detect at least one paper sheet to be transported to the loop portion; a drive unit configured to transport a paper sheet in the transport path, such that a paper sheet in the loop portion and a paper sheet in another part of the transport path are transported independently from each other or in synch with each other; and a control unit configured to control the drive unit in such a manner that, when the detecting unit detects at least the one paper sheet, the detected paper sheet and a bundle of paper sheet(s) escrowed in the loop portion are merged to each other, such that a designated portion of the detected paper sheet and a designated portion of the escrowed bundle of paper sheet have a predetermined positional relationship, and that the merged paper sheets are escrowed in the loop portion; and the control unit is configured to control the drive unit such that, after the detected paper sheet and the escrowed bundle of paper sheet have been merged or partly merged to each other, the merged or partly-merged paper sheets are accelerated in at least the loop portion.

In the paper-sheet handling apparatus of the present invention, the control unit may be configured to control the drive unit such that, after the detected paper sheet and the escrowed bundle of paper sheet had been merged or partly merged to each other and the merged or partly-merged paper sheets have been transported by a predetermined distance in the loop portion, these paper sheets are accelerated.

Alternatively, the control unit may be configured to control the drive unit such that, after the detected paper sheet and the escrowed bundle of paper sheet had been merged or partly merged to each other and the rear end edge of the paper sheet that has been sent from the upstream side of the loop portion to the loop portion passes through a preset predetermined position, the merged or partly-merged paper sheets are accelerated.

Alternatively, the control unit may be configured to control the drive unit such that, after the detected paper sheet and the escrowed bundle of paper sheet have been merged or partly merged to each other, the merged or partly-merged paper sheets are accelerated in the loop portion, and that, when a speed of the merged or partly-merged paper sheets reaches a preset predetermined speed, the merged or partly-merged paper sheets are transported at this predetermined speed and are then decelerated.

In the paper-sheet handling apparatus of the present invention, the loop portion of the transport path may be provided with a movable width adjusting mechanism configured to adjust a width of the loop portion, and the width adjusting mechanism may be configured to vary the width of the loop portion, based on the number of paper sheet(s) escrowed in the loop portion.

In the paper-sheet handling apparatus of the present invention, after the detected paper sheet and the escrowed bundle of paper sheet have been partly merged to each other, when the partly-merged paper sheets are accelerated in the loop portion, a part on a rear end side of the detected paper sheet that does not reach the loop portion may be pulled by a front end side of the detected paper sheet, and thus is accelerated. In this case, a roller configured to transport a paper sheet and a motor configured to drive the motor may be disposed in the transport path at a position on an upstream side relative to the loop portion, while a one-way clutch may be disposed between the motor and the roller, and when the partly-merged paper sheets are accelerated in the loop portion, the part on the rear end side of the detected paper sheet that does not reach the loop portion may be accelerated, by releasing the roller from a connection between the roller and the motor by means of the one-way clutch.

The paper-sheet handling apparatus of the present invention may further include a cylindrical rotary body that is rotatably disposed; a transport belt that is in contact with at least a part of an outer peripheral surface of the rotary body; and a motor configured to drive the transport belt; and at least a part of the loop portion of the transport path is formed between the rotary body and the transport belt.

At this time, the rotary body may be provided with a plurality of rollers along the outer peripheral surface of the rotary body, and in the loop portion of the transport path, the transport belt may be configured to be in contact with either one of the respective rollers and the outer peripheral surface of the rotary body.

In addition, the outer peripheral surface of the rotary body may be formed between one roller group including the plurality of rollers in a row and another roller group, in an area between one roller group and another roller group, the transport belt may be configured to be in contact with the outer peripheral surface of the rotary body, and at a position on which each of the roller groups is disposed, the transport belt may be configured to be in contact with the respective rollers.

A paper-sheet handling method of the present invention is a paper-sheet handling method including: transporting at least one paper sheet, at a position on an upstream side relative to a loop portion of a transport path, toward the loop portion; detecting at least one paper sheet by a detecting unit located on the transport path at a position on the upstream side relative to the loop portion; transporting and escrowing a bundle of paper sheet(s) in the loop portion of the transport path; merging at least the one paper sheet detected by the detecting unit, to the bundle of paper sheet escrowed in the loop portion of the transport path; and discharging the bundle of paper sheets escrowed in the loop portion to the transport path; and after the detecting unit has detected at least the one paper sheet, the detected paper sheet and the bundle of paper sheet escrowed in the loop portion are merged to each other, such that a designated portion of the detected paper sheet and a designated portion of the escrowed bundle of paper sheet have a predetermined positional relationship, and the merged paper sheets are escrowed in the loop portion; and after the detected paper sheet and the escrowed bundle of paper sheet have been merged or partly merged to each other, the merged or partly-merged paper sheets are accelerated in at least the loop portion.

DETAILED DESCRIPTION OF THE INVENTION

A paper-sheet handling apparatus and a paper-sheet handling method in one embodiment of the present invention will be described herebelow with reference to the drawings. FIGS. 1 to 13 are views showing the paper-sheet handling apparatus and the paper-sheet handling method in one embodiment of the present invention.

At first, a structure of the paper-sheet handling apparatus in this embodiment is schematically described. The paper-sheet handling apparatus in this embodiment is an apparatus in which a plurality of paper sheets, such as banknotes, checks and so on, of different lengths are sequentially fed out, one by one, to an inside, each of the paper sheets, which have been fed out to the inside, is recognized whether the paper sheet is a reject paper sheet (such as a counterfeit banknote, a damaged paper sheet, an unreadable paper sheet and so on) or not, the reject paper sheet is returned to the outside, a normal paper sheet, which is not the reject paper sheet, is escrowed, and thereafter, the normal banknote is sent to another apparatus connected to the paper-sheet handling apparatus.

Figure 1:
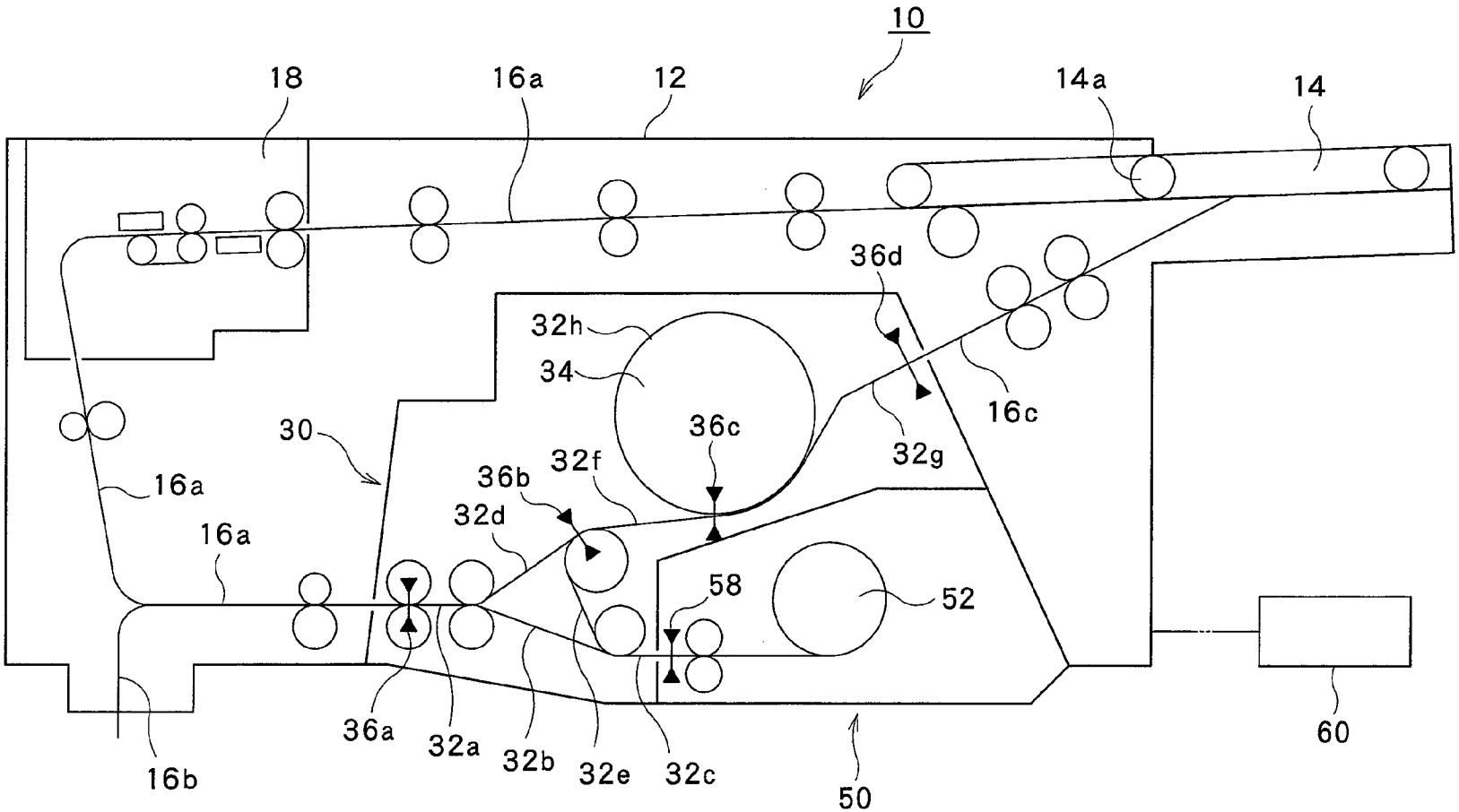
FIG. 1 is a schematic structural view showing a structure of a paper-sheet handling apparatus in one embodiment of the present invention.

As shown in FIG. 1, the paper-sheet handling apparatus 10 in this embodiment includes: a housing 12; a feeding unit 14*a* configured to feed out a banknote, which has been put into an inlet 14 of the paper-sheet handling apparatus 10, one by one, to the inside of the housing 12; a paper-sheet stacking unit (bunching unit) 30 disposed inside the housing 12; and a paper-sheet escrow unit (escrow unit) 50 disposed inside the housing 12. In addition, inside the housing 12 of the paper-sheet handling apparatus 10, there are disposed transport units 16*a* to 16*c* configured to transport a paper sheet. The transport unit 16*a* is provided with a recognition unit 18 configured to recognize a paper sheet. In addition, the paper-sheet handling apparatus 10 includes a control unit 60 configured to control the feeding unit 14*a*, the transport units 16*a* to 16*c*, the paper-sheet stacking unit 30, the paper-sheet escrow unit 50 and so on.

Details of the respective constituent elements of the paper-sheet handling apparatus 10 are described below.

As shown in FIG. 1, the transport units 16*a* to 16*c* configured to transport a paper sheet are disposed inside the housing 12. The transport unit 16*a* is configured to transport a paper sheet which has been fed out from the feeding unit 14*a* to the inside of the housing 12. The transport unit 16*a* is connected to the paper-sheet stacking unit 30. Thus, the transport unit 16*a* is configured to transport a paper sheet, which has been fed out from the feeding unit 14*a* to the inside of the housing 12 and recognized by the recognition unit 18, to the paper-sheet stacking unit 30. The transport unit 16*a* is diverged, and the transport unit 16*b* diverged therefrom extends to the outside of the housing 12. Due to the transport unit 16*b*, a paper sheet, which has been escrowed in the below-described paper-sheet escrow unit 50, is transported to another apparatus (for example, when a check is used as a paper sheet, a check storage apparatus in an ATM) outside the paper-sheet handling apparatus 10. The transport unit 16*c* is disposed between the paper-sheet stacking unit 30 and the inlet 14, and is configured to send a bundle of paper sheet(s) sent from the paper-sheet stacking unit 30 to the inlet 14.

The recognition unit 18 disposed on the transport unit 16*a* is configured to recognize whether a paper sheet, which has been fed out to the inside of the housing 12 by the feeding unit 14*a*, is a reject paper sheet (such as a counterfeit banknote, a damaged paper sheet, an unreadable paper sheet and so on) or not. A paper-sheet recognition result by the recognition unit 18 is transmitted to the control unit 60.

Figure 2:
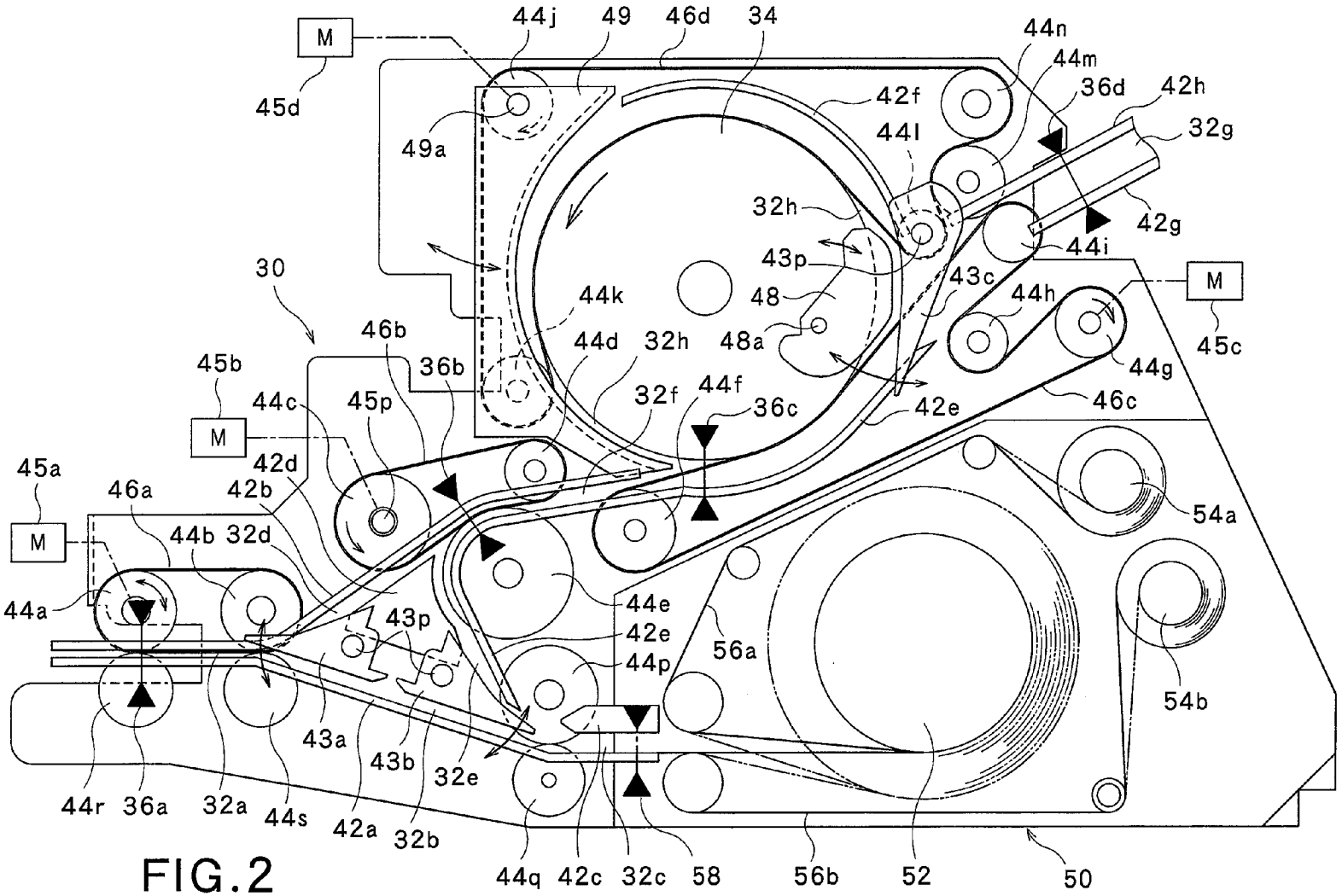
FIG. 2 is an enlarged view showing detailed structures of a paper-sheet stacking unit (bunching unit) and a paper-sheet escrow unit (escrow unit) of the paper-sheet handling apparatus shown in FIG. 1.

Next, the structure of the paper-sheet stacking unit (bunching unit) 30 is described in detail, with reference to FIGS. 1 and 2. Schematically, the paper-sheet stacking unit 30 is configured to escrow a reject paper sheet(s) out of paper sheets fed out into the housing 12 by the feeding unit 14*a*, and thereafter to discharge the reject paper sheets in a bundle state, with front end edges or rear end edges of the reject paper sheets being aligned with each other.

As shown in FIG. 1, the paper-sheet stacking unit 30 is provided with a plurality of transport paths 32*a* to 32*h* along which a paper sheet is transported. Specifically, the transport path 32*a* is connected to the aforementioned transport unit 16*a*, so that a paper sheet is transported from the transport unit 16*a* to the transport path 32*a*. The two transport paths 32*b* and 32*d* are diverged from the transport path 32*a*. The transport path 32*c* is further connected to the transport path 32*b*. The transport path 32*c* is connected to the below-described paper-sheet escrow unit 50. The transport path 32*e* extends from the connection position between the transport path 32*b* and the transport path 32*c*. The transport path 32*d* and the transport path 32*e* are merged to each other, and the transport path 32*f* extends from the merged position. The transport path 32*h* of a loop shape is connected to the transport path 32*f*. To be more specific, the paper-sheet stacking unit 30 is provided with a cylindrical rotary body 34, and the transport path 32*h* is formed along an outer periphery of the rotary body 34. In addition, the transport path 32*g* is diverged from the loop-shaped transport path 32*h*, and the transport unit 16*c* is connected to the transport path 32*g*. A paper sheet is sent from the transport path 32*g* to the transport unit 16*c*, and the paper sheet is returned from the transport unit 16*c* to the inlet 14.

Out of the respective transport paths 32*a* to 32*h* as described above, a loop portion, which is capable of transporting and escrowing a paper-sheet bundle, is structured by the loop-shaped transport path 32*h*. Specifically, in the transport path 32*h*, a paper-sheet bundle is transported in the counterclockwise direction of FIGS. 1 and 2, and the paper-sheet bundle is circulated in the transport path 32*h* so as to be escrowed. In the paper-sheet stacking unit 30, the transport paths 32*a*, 32*b*, 32*c*, 32*d*, 32*e* and 32*f* are respectively located on an upstream side relative to the transport path 32*h* serving as the loop portion. On the other hand, in the paper-sheet stacking unit 30, the transport path 32*g* is located on a downstream side relative to the transport path 32*h* serving as the loop portion.

Next, the structure of the paper-sheet stacking unit 30 is described in more detail with reference to FIG. 2. As shown in FIG. 2, the paper-sheet stacking unit 30 is provided with a plurality of guide members 42*a* to 42*h* configured to guide a paper sheet. The transport path 32*a* is formed between the guide member 42*a* and the guide member 42*b*. The transport path 32*c* is formed between the guide member 42*a* and the guide member 42*c*. The transport path 32*d* is formed between the guide member 42*b* and the guide member 42*d*. The transport path 32*e* is formed between the guide member 42*d* and the guide member 42*e*. The transport path 32*f* is formed between the guide member 42*b* and the guide member 42*e*. The guide member 42*f* is formed along the outer periphery of the rotary body 34. The transport path 32*g* is formed between the guide member 42*g* and the guide member 42*h*.

In addition, the paper-sheet stacking unit 30 is provided with a plurality of rollers 44*a* to 44*n* and 44*p* to 44*s*. An endless transport belt 46*a* goes around the roller 44*a* and the roller 44*b*, so that a paper sheet is transported by the transport belt 46*a* in the transport path 32*a*. A motor 45*a* is connected to the roller 44*a*, so that the roller 44*a* is rotated by the motor 45*a* at a constant speed in the clockwise direction or in the counterclockwise direction of FIG. 2. In the transport path 32*a*, the roller 44*r* and 44*s* are respectively disposed oppositely to the rollers 44*a* and 44*b*. The respective rollers 44*r* and 44*s* are in contact with the rollers 44*a* and 44*b* through the transport belt 46*a*. Driving of the motor 45*a* is controlled by the control unit 60.

In addition, an endless transport belt 46*b* goes around the roller 44*c* and the roller 44*d*, so that a paper sheet is transported by the transport belt 46*b* in the transport paths 32*d* and 32*f*. A motor 45*b* is connected to the roller 44*c* through a one-way clutch 45*p*, so that the roller 44*c* is rotated by the motor 45*b* at a constant speed in the counterclockwise direction of FIG. 2. In addition, even when the motor 45*b* is stopped, the roller 44*c* can be rotated in the counterclockwise direction of FIG. 2. Driving of the motor 45*b* is controlled by the control unit 60. An outer peripheral surface of the roller 44*e* is in contact with the transport belt 46*b*, so that, when the transport belt 46*b* is moved to be circulated, the roller 44*e* is rotated in the clockwise direction of FIG. 2. In place of the two motors 45*a* and 45*b*, it is possible to use one motor, and to distribute driving forces by the one motor by means of a timing belt or the like.

In addition, an endless transport belt 46*c* goes around the roller 44*f*, the roller 44*g*, the roller 44*h* and the roller 44*i*, so that a paper sheet is transported by the transport belt 46*c* in the transport paths 32*f*, 32*g* and 32*h*. The roller 44*i* is configured to move forward or backward toward the roller 44*m*, in accordance with a thickness of a paper-sheet bundle transported in the transport path 32*g*. A stepping motor 45*c* is connected to the roller 44*g*, so that the roller 44*g* is rotated by the stepping motor 45*c* in the clockwise direction of FIG. 2. Driving of the stepping motor 45*c* is controlled by the control unit 60. A part of the outer peripheral surface of the rotary body 34 is in contact with the transport belt 46*c*, so that a part of the transport path 32*h* is formed between the transport belt 46*c* and the rotary body 34.

An endless transport belt 46*d* goes around the roller 44*j*, the roller 44*k*, the roller 44*l*, the roller 44*m* and the roller 44*n*, so that a paper sheet is transported by the transport belt 46*d* in the transport path 32*h*. A stepping motor 45*d* is connected to the roller 44*j*, so that the roller 44*j* is rotated by the stepping motor 45*d* in the clockwise direction of FIG. 2. Driving of the stepping motor 45*d* is controlled by the control unit 60. A part of the outer peripheral surface of the rotary body 34 is in contact with the transport belt 46*d*, so that a part of the transport path 32*h* is formed between the transport belt 46*d* and the rotary body 34. In place of the two motors 45*c* and 45*d*, it is possible to use one motor, and to distribute driving forces by the one motor by means of a timing belt or the like.

As described above, since the transport belts 46*c* and 46*d* are in contact with the outer peripheral surface of the rotary body 34, when the transport belts 46*c* and 46*d* are moved to be circulated, the rotary body 34 is rotated in the counterclockwise direction of FIG. 2.

The stepping motors 45*c* and 45*d* are motors whose rotation speeds can be controlled, whereby the rotation speeds of the roller 44*g* and the roller 44*j* can be varied based on a command from the control unit 60. Thus, a transport speed of a paper sheet in the transport path 32*h* can be varied.

A pair of rollers 44*p* and 44*q* are disposed on a connection position between the transport path 32*b* and the transport path 32*c*. Thus, a paper sheet, which is to be sent to the paper-sheet escrow unit 50 or has been returned from the paper-sheet escrow unit 50, passes through the space between the pair of rollers 44*p* and 44*q*.

In addition, diverge members 43*a* to 43*c*, which are configured to send a paper sheet to either one of the transport paths, are disposed on the diverged positions in the transport paths of the paper-sheet stacking unit 30. As shown in FIG. 2, the transport path 32*b* is formed between the diverge members 43*a* and 43*b* and the guide member 42*a*. Each of the diverge members 43*a* to 43*c* is configured to be swung about a shaft 43*p*, as shown by the arrows in FIG. 2. To be more specific, the diverge member 43*a* is disposed on the diverged position at which the transport path 32*a* is diverged to the transport paths 32*b* and 32*d*. Thus, by means of the diverge member 43*a*, a paper sheet, which has been sent from the transport path 32*a*, is selectively sent to either one of the transport paths 32*b* and 32*d*. In addition, the diverge member 43*b* is disposed on the diverged position at which the transport path 32*c* is diverged to the transport paths 32*b* and 32*e*. Thus, by means of the diverge member 43*b*, a paper sheet, which has been sent from the transport path 32*c*, is selectively sent to either one of the transport paths 32*b* and 32*e*.

In addition, the diverge member 43*c* is disposed on the diverged position at which the loop-shaped transport path 32*h* is diverged to the transport path 32*g*. Thus, by means of the diverge member 43*c*, it is determined whether a paper sheet is continuously transported so as to be escrowed in the transport path 32*h*, or the paper sheet is sent from the transport path 32*h* to the transport path 32*g* so as to be returned from the transport path 32*g* to the inlet 14. Specifically, when the diverge member 43*c* is in a position shown in FIG. 2, a paper sheet is continuously transported so as to be escrowed in the transport path 32*h*. On the other hand, when the diverge member 43*c* is rotated about the shaft 43*p* from the position shown in FIG. 2 in the clockwise direction, a paper sheet is transported by the transport belt 46*c* from the transport path 32*h* to the transport path 32*g* so as to be returned from the transport unit 16*c* to the inlet 14. Driving of these diverge members 42*a* to 42*c* is controlled by the control unit 60.

In addition, the respective transport paths of the paper-sheet stacking unit 30 are provided with paper-sheet detecting sensors 36*a* to 36*d*, which are formed of, e.g., optical sensors, for detecting a paper sheet transported in the transport paths. The paper-sheet detecting sensors 36*a* and 36*b* are disposed on the transport path on the upstream side relative to the loop portion (i.e., the transport paths 32*h*). The paper-sheet detecting sensor 36*c* is disposed on the loop portion in the transport path. The paper-sheet detecting sensor 36*d* is disposed on the transport path on the downstream side relative to the loop portion. More specifically, the paper-sheet detecting sensor 36*a* is located on the transport path 32*a* so as to detect a paper sheet passing through the transport path 32*a*. The paper-sheet detecting sensor 36*b* is located on the transport path 32*f* so as to detect a paper sheet passing through transport path 32*f*. The paper-sheet detecting sensor 36*c* is located on the transport path 32*h* so as to detect a paper sheet passing through the transport path 32*h*. The paper-sheet detecting sensor 36*c* is located on an entrance of the loop portion of the transport path 32*h*, i.e., a position at which the transport path 32*f* is merged to the transport path 32*h*. The paper-sheet detecting sensor 36*d* is located on the transport path 32*g* so as to detect a paper sheet passing through the transport path 32*g*. A paper-sheet detection result by each of the paper-sheet detecting sensors 36*a* to 36*d* is transmitted to the control unit 60.

The transport path 32*h* of the paper-sheet stacking unit 30 is provided with a first width adjusting member 48 and a second width adjusting member 49. The respective width adjusting members 48 and 49 are configured to adjust a width of the transport path 32*h*. In more detail, each of the width adjusting members 48 and 49 is configured to vary the width of the transport path 32*h*, based on the number of paper sheet(s) escrowed in the transport path 32*h*.

As shown by the arrow in FIG. 2, the first width adjusting member 48 is configured to be swung about a shaft 48*a*, and to be urged by an urging means such as a torsion spring or the like, in the clockwise direction of FIG. 2. When no force is applied to the first width adjusting member 48, the first width adjusting member 48 is maintained on a position shown in FIG. 2. On the other hand, when the number of paper sheets transported in the transport path 32*h* increases, a thickness of the paper-sheet bundle increases. In this case, a force is applied to the first width adjusting member 48 by the paper-sheet bundle that is transported in the transport path 32*h*, whereby the first width adjusting member 48 is rotated about the shaft 48*a* in the counterclockwise direction of FIG. 2. This widens the width of the transport path 32*h*. Thus, even when the number of paper sheets to be transported in the transport path 32*h* increases, the paper-sheet bundle can be transported in the transport path 32*h* without any problem.

As shown by the arrow in FIG. 2, the second width adjusting member 49 is configured to be swung about a shaft 49*a*, and to be urged by an urging means such as a torsion spring or the like, in the counterclockwise direction of FIG. 2. When no force is applied to the second width adjusting member 49, the second width adjusting member 49 is maintained on a position shown in FIG. 2. On the other hand, when the number of paper sheets transported in the transport path 32*h* increases, a thickness of the transported paper-sheet bundle increases. In this case, a force is applied to the second width adjusting member 49 by the paper-sheet bundle that is transported in the transport path 32*h*, whereby the second width adjusting member 49 is rotated about the shaft 49*a* in the clockwise direction of FIG. 2. This widens the width of the transport path 32*h*. Thus, even when the number of paper sheets to be transported in the transport path 32*h* increases, the paper-sheet bundle can be transported in the transport path 32*h* without any problem. The roller 44*k* is fixed on the second width adjusting member 49. Thus, when the second width adjusting member 49 is rotated about the shaft 49*a*, the roller 44*k* is moved in accordance with the second width adjusting member 49.

Due to the provision of the movable width adjusting members 48 and 49, the width of the transport path 32*h* can be varied following a thickness of a paper-sheet bundle. Thus, a position through which a paper-sheet bundle transported in the transport path 32*h* passes can be restricted. Accordingly, it can be restrained that, while the paper-sheet bundle is transported in the loop-shaped transport path 32*h*, an innermost paper sheet and an outermost paper sheet are displaced from each other, by a difference between an inner peripheral speed and an outer peripheral speed.

Next, the structure of the paper-sheet escrow unit (escrow unit) 50 is described in detail with reference to FIGS. 1 and 2. Schematically, the paper-sheet escrow unit 50 is configured to wind and escrow, one by one, a normal paper sheet which is not a reject paper sheet, out of a paper sheet fed out into the housing 12 by the feeding unit 14*a*, and to unwind, one by one, the wound paper sheet so as to discharge the same.

As shown in FIG. 2, the paper-sheet escrow unit 50 is provided with a winding roller 52 configured to wind a paper sheet. A pair of tapes 56*a* and 56*b* are wound on the winding roller 52. Thus, under a state in which a paper sheet is sandwiched between the pair of tapes 56*a* and 56*b*, the paper sheet is sequentially wound, one by one, on the winding roller 52. In FIG. 2, the two-dot chain lines show a state in which large parts of the pair of tapes 56*a* and 56*b* are wound on the winding roller 52.

The winding roller 52 is configured to be rotated about a shaft that is perpendicular to the sheet plane of FIG. 2, in both of the clockwise direction and the counterclockwise direction of FIG. 2. First ends of the tapes 56*a* and 56*b* are attached to an outer peripheral surface of the winding roller 52 at the same position. When the winding roller 52 is rotated in the counterclockwise direction of FIG. 2, these tapes 56*a* and 56*b* are wound on the winding roller 52. Driving of the winding roller 52 is controlled by the control unit 60.

In addition, as shown in FIG. 2, there are provided winding rollers 54*a* and 54*b* in the paper-sheet escrow unit 50, to which the other ends of the respective tapes 56*a* and 56*b* are connected. The winding rollers 54*a* and 54*b* are respectively configured to wind the tapes 56*a* and 56*b*. Namely, the first ends of the respective tapes 56*a* and 56*b* are wound on the winding roller 52, and the other ends thereof are wound on the winding rollers 54*a* and 54*b*. Driving of these winding rollers 54*a* and 54*b* is controlled by the control unit 60. As shown in FIG. 2, a paper sheet, which has been sent from the transport path 32*c* of the paper-sheet stacking unit 30 to the paper-sheet escrow unit 50, is sandwiched between the pair of tapes 56*a* and 56*b*. When the winding roller 52 is rotated in the counterclockwise direction of FIG. 2, the paper sheet, together with the pair of tapes 56*a* and 56*b*, is wound, one by one, on the winding roller 52.

On a portion through which a paper sheet is let in or out the paper-sheet escrow unit 50, there is disposed a paper-sheet detecting sensor 58, which is formed of, e.g., an optical sensor, for detecting a paper sheet. The paper-sheet detecting sensor 58 is configured to detect a paper sheet, which has been sent from the transport path 32*c* of the paper-sheet stacking unit 30 to the paper-sheet escrow unit 50, and to detect a paper sheet, which has been unwound from the winding roller 52 of the paper-sheet escrow unit 50 so as to be released from an area between the pair of tapes 54*a* and 54*b*.

Figure 3:
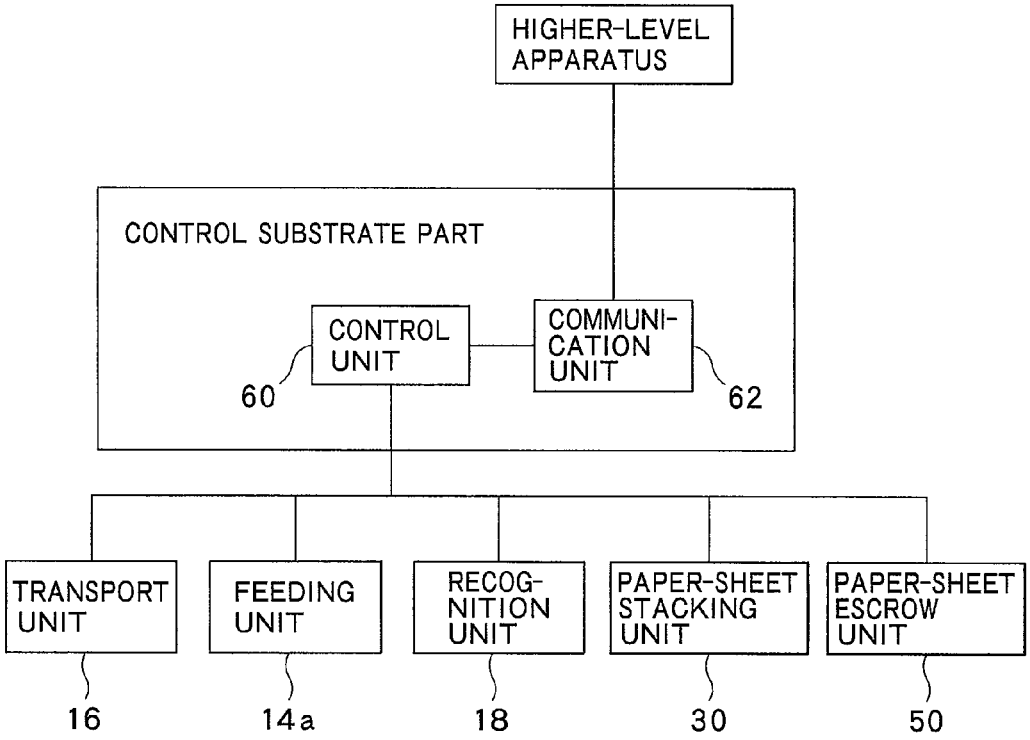
FIG. 3 is a block diagram showing a structure of a control unit of the paper-sheet handling apparatus shown in FIG. 1.

As shown in FIG. 3, the control unit 60 is connected to the respective feeding unit 14*a*, the transport units 16*a* to 16*c*, the recognition unit 18, the paper-sheet stacking unit 30 and the paper-sheet escrow unit 50. A paper-sheet recognition result by the recognition unit 18 is transmitted to the control unit 60. In addition, the control unit 60 is configured to transmit control signals to the respective feeding unit 14*a*, the transport units 16*a* to 16*c*, the paper-sheet stacking unit 30 and the paper-sheet escrow unit 50, so as to control them. Details of the control contents by the control unit 60 will be described below.

As shown in FIG. 3, a command may be given to the control unit 60, provided on the paper-sheet handling apparatus 10 in this embodiment, from a higher-level apparatus of the paper-sheet handling apparatus 10 through a communication unit 62. In addition, the control unit 60 may have a minimum structure for controlling only a unit composed of the paper-sheet stacking unit 30 and the paper-sheet escrow unit 50. Alternatively, as shown in FIG. 3, the control unit 60 may be configured to control a unit including, in addition to the paper-sheet stacking unit 30 and the paper-sheet escrow unit 50, the transport unit 16, the recognition unit 18 and the feeding unit 14*a*. Alternatively, the control unit 60 may control an overall apparatus such as an ATM.

Next, an operation of such a paper-sheet handling apparatus 10 is described with reference to FIGS. 4 to 13. The below-described operation of the paper-sheet handling apparatus 10 is performed by the control unit 60 controlling the respective constituent elements of the paper-sheet handling apparatus 10. Various types of paper sheets of different lengths can be placed by a user on the inlet 14 of the paper-sheet handling apparatus 10.

Figure 4:
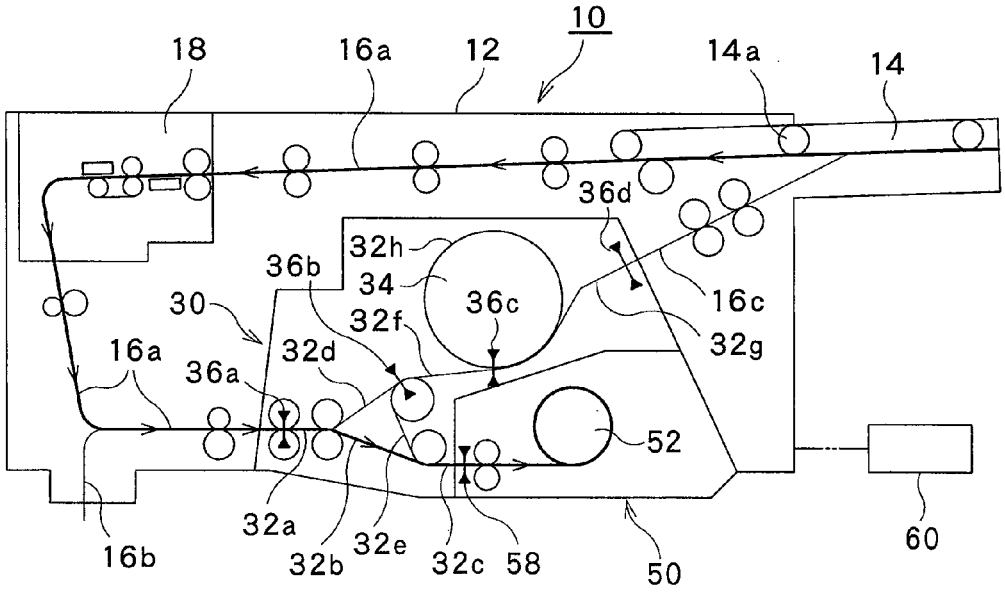
FIG. 4 is an explanatory view showing a paper-sheet route in the paper-sheet handling apparatus shown in FIG. 1, along which a paper sheet fed out into a housing by a feeding unit is transported to the paper-sheet escrow unit.

First, in the paper-sheet handling apparatus 10, a case in which a normal paper sheet, which is not a reject paper sheet, is fed out to the inside of the housing 12 by the feeding unit 14*a* is described with reference to FIG. 4.

A paper sheet, which has been put by a user into the inlet 14 of the paper-sheet handling apparatus 10, is fed out, one by one, into the housing 12 by the feeding unit 14*a*. The paper sheet fed out by the feeding unit 14*a* is transported by the transport unit 16*a*, and recognized by the recognition unit 18. As shown in FIG. 4, a paper sheet, which has been recognized not as a reject paper sheet but as a normal paper sheet by the recognition unit 18, is sent from the transport unit 16*a* to the transport path 32*a* of the paper-sheet stacking unit 30, and is sent from the transport path 32*a* to the paper-sheet escrow unit 50 through the transport paths 32*b* and the transport path 32*c*. The paper sheet sent to the paper-sheet escrow unit 50, together with the pair of tapes 56*a* and 56*b*, is wound, one by one, on the winding roller 52, under a state in which the paper sheet is sandwiched between the pair of tapes 56*a* and 56*b*. In this manner, the paper sheet is escrowed in the paper-sheet escrow unit 50.

Figure 5:
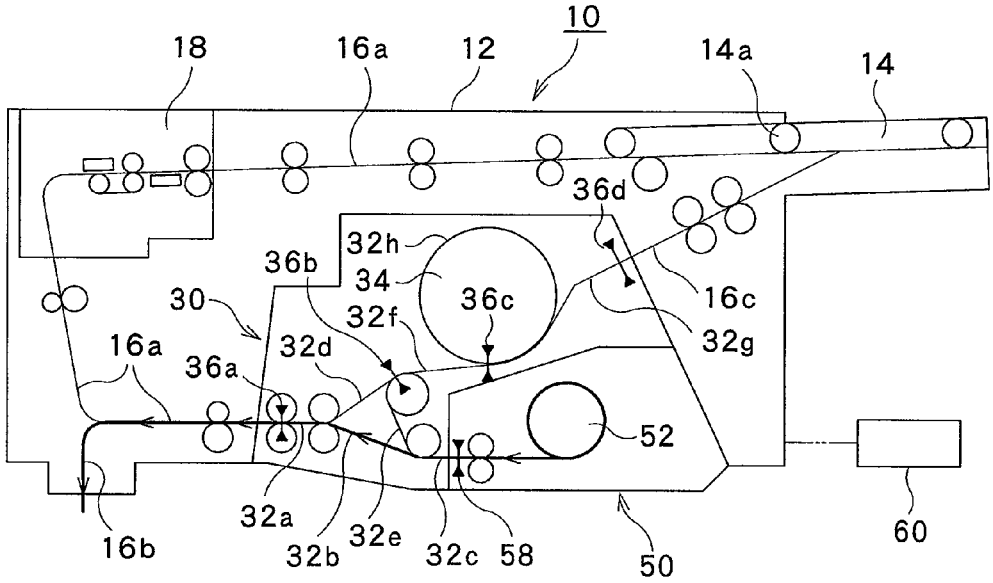
FIG. 5 is an explanatory view showing a paper-sheet route in the paper-sheet handling apparatus shown in FIG. 1, along which a paper sheet escrowed in the paper-sheet escrow unit is transported to another apparatus outside the paper-sheet handling apparatus.

After the paper sheet has been escrowed in the paper-sheet escrow unit 50, when the higher-level apparatus or the like gives a command to the control unit 60, such that the escrowed paper sheet is sent to another apparatus outside the paper-sheet handling apparatus 10, the paper sheet wound on the winding roller 52 is sequentially unwound, one by one, so as to be released from the area between the pair of tapes 56*a* and 56*b*. As shown in FIG. 5, the released paper sheet is sent from the paper-sheet escrow unit 50 to the transport path 32*c* of the paper-sheet stacking unit 30, and is sent from the transport path 32*c* to the transport unit 16*a* through the transport path 32*b* and the transport path 32*a*. Further, the paper sheet is sent from the transport unit 16*a* to the transport unit 16*b*, and is sent from the transport unit 16*b* to the outside of the paper-sheet handling apparatus 10.

Figure 6:
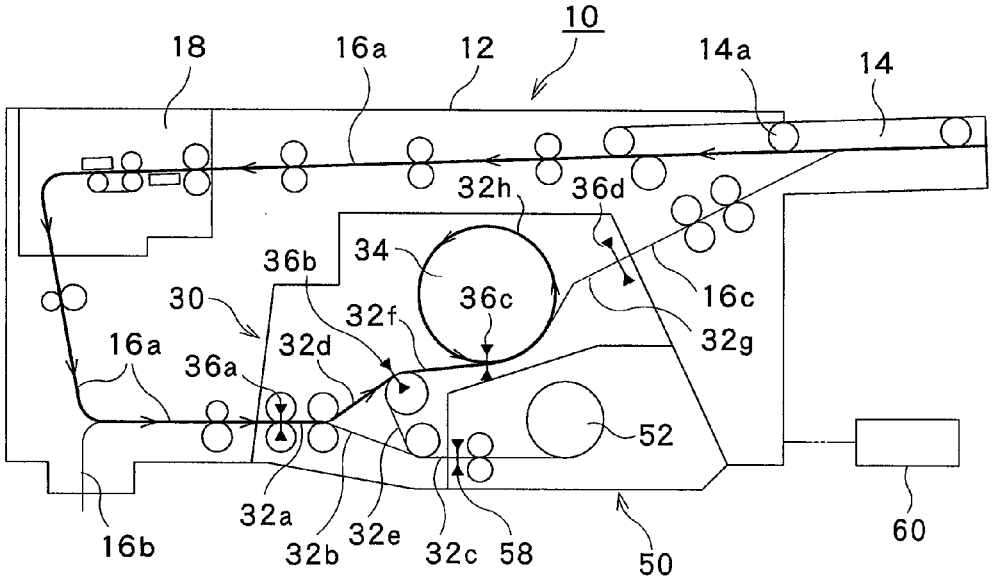
FIG. 6 is an explanatory view showing a paper-sheet route in the paper-sheet handling apparatus shown in FIG. 1, along which a paper sheet fed out into the apparatus by the feeding unit is transported to the paper-sheet stacking unit.

Next, in the paper-sheet handling apparatus 10, a case in which a reject paper sheet (such as a counterfeit banknote, a damaged paper sheet, an unreadable paper sheet and so on) is fed out into the housing 12 by the feeding unit 14*a* is described with reference to FIG. 6.

A paper sheet, which has been put by a user into the inlet 14 of the paper-sheet handling apparatus 10, is fed out, one by one, into the housing 12 by the feeding unit 14*a*. The paper sheet fed out by the feeding unit 14*a* is transported by the transport unit 16*a*, and is recognized by the recognition unit 18. A paper sheet, which has been recognized as a reject paper sheet by the recognition unit 18, is sent from the transport unit 16*a* to the transport path 32*a* of the paper-sheet stacking unit 30, and is sent from the transport path 32*a* to the transport path 32*h* through the transport path 32*d* and the transport path 32*f*. At this time, the rotary body 34 is rotated by the transport belts 46*c* and 46*d* in the counterclockwise direction of FIG. 2, whereby the paper sheet sent to the transport path 32*h* is moved to be circulated in the loop-shaped transport path 32*h*. Since reject banknotes, out of the paper sheets sequentially fed out into the housing 12 by the feeding unit 14*a*, are sent to the transport path 32*h* one after another, the plurality of paper sheets are escrowed in a bundle state in the transport path 32*h*.

In the loop-shaped transport path 32*h* of the paper-sheet stacking unit 30, the plurality of paper sheets are transported in a bundle state, with designated portions thereof in the transport direction being aligned with each other. Specifically, in the transport path 32*h*, the paper sheets are moved to be circulated in a bundle state, with front end edges or rear end edges of the paper sheets being aligned with each other. The designated portion of a paper sheet in the transport direction may be a position at which a ratio of distance from a front end edge of a paper sheet to the designated portion, relative to the entire length of the paper sheet in the transport direction, takes a certain value. Herein, a method of aligning front end edges of a plurality of paper sheets in the loop-shaped transport path 32*h* is firstly described with reference to FIGS. 7 to 10.

Figure 7:
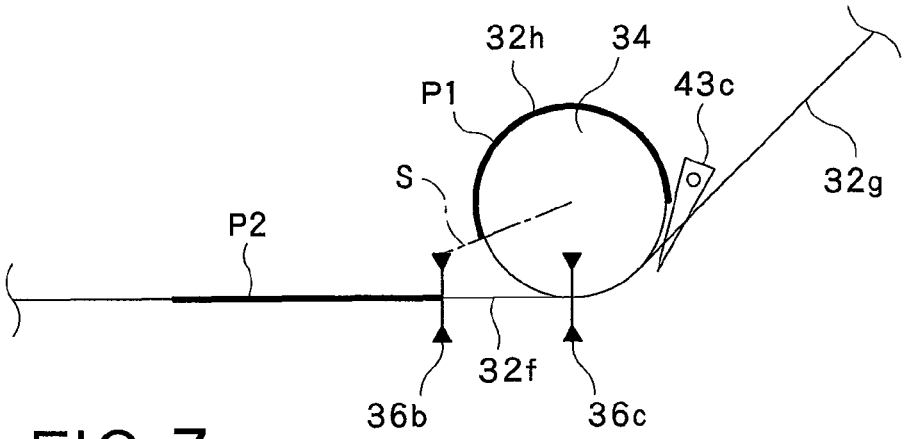
FIG. 7 is an explanatory view showing a state in the paper-sheet stacking unit of the paper-sheet handling apparatus shown in FIG. 1 in which, during an operation for aligning front end edges of paper sheets, when a front end edge of a paper-sheet bundle is located at a waiting position in a loop-shaped transport path, a front end edge of a paper sheet reaches a paper-sheet detecting sensor in a transport path on an upstream side relative to the loop-shaped transport path.
Figure 10:
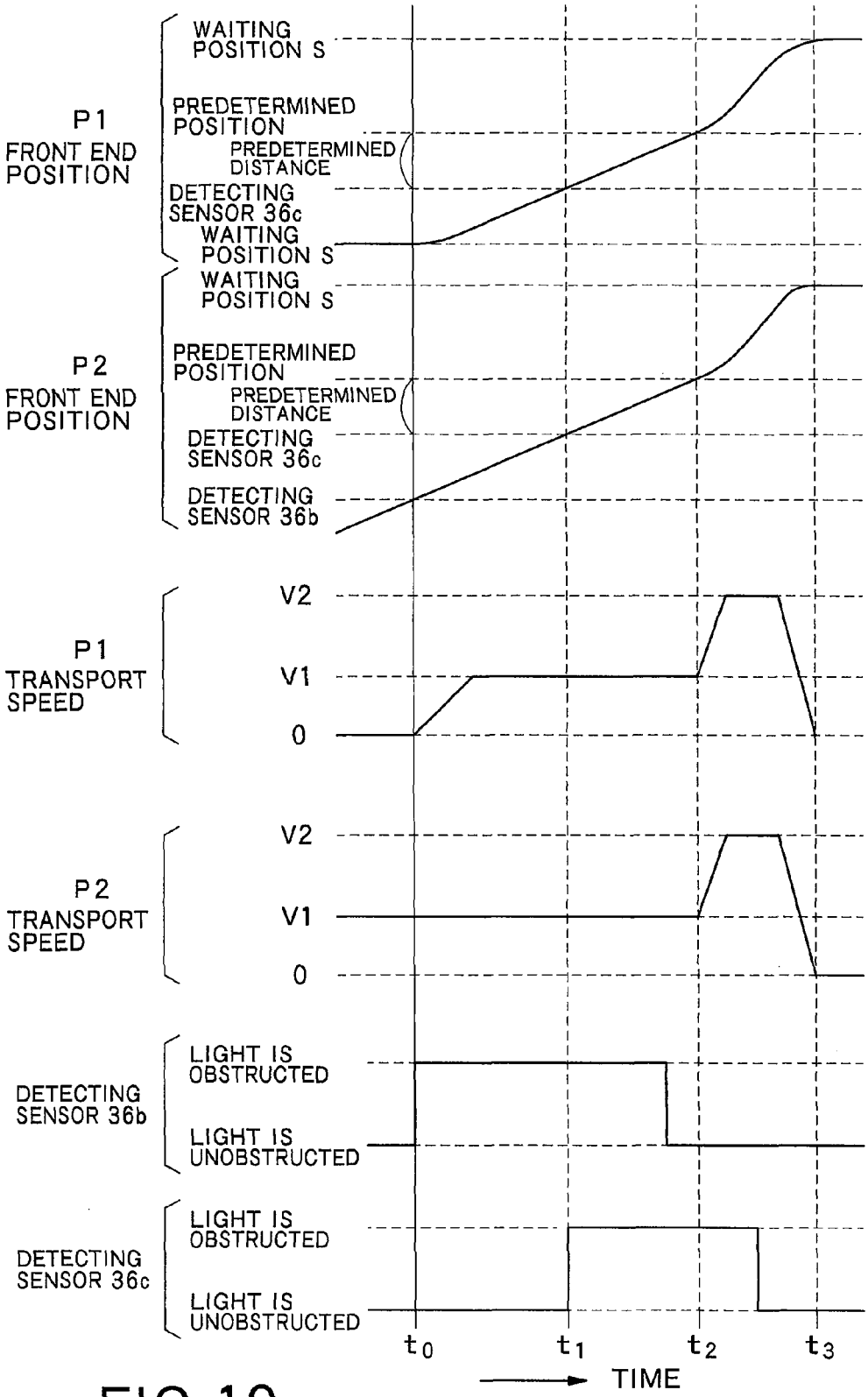
FIG. 10 is a timing chart in the operation of the paper-sheet stacking unit shown in FIGS. 7 to 9.

In an initial state, the transport belts 46*c* and 46*d* are stopped, so that the rotary body 34 is generally stopped. As shown in FIG. 7, a bundle of paper sheet(s) P1 in the loop-shaped transport path 32*h* is stopped such that a front end edge thereof is located on a predetermined waiting position S. Under this state, a new paper sheet P2 is sent to the transport path 32*f* at a speed V1 (a constant speed of, e.g., 700 mm/s), and light of the paper-sheet detecting sensor 36*b* disposed on the transport path 32*f* is obstructed by a front end edge of the new paper sheet P2. As shown in FIG. 10, the time point at which the light of the paper sheet detecting sensor 36 is obstructed by the front end edge of the paper sheet P2 is shown by $t_0$. When the light of the paper-sheet detecting sensor 36 is obstructed by the front end edge of the paper sheet P2, the control unit 60 starts to move to circulate the transport belts 46*c* and 46*d* by the stepping motors 45*c* and 45*d*, so as to start to rotate the rotary body 34. At this time, the rotary body 34 is accelerated at a uniform acceleration speed. When the speed of the rotary body 34 reaches the speed V1 of the paper sheet P2, the rotary body 34 is rotated uniformly at the speed V1. Thus, in the transport path 32*h*, the paper sheet P1 is transported at the speed V1.

Figure 8:
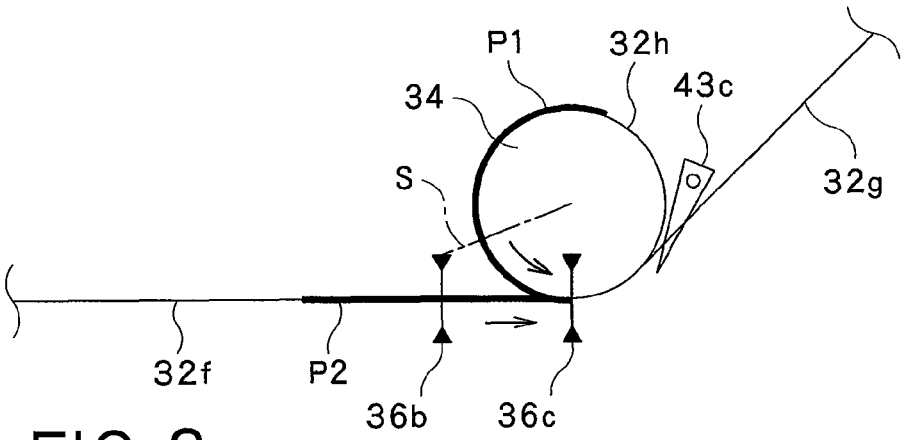
FIG. 8 is a view showing a state in which, after the state shown in FIG. 7, the front end edge of the paper sheet detected by the paper-sheet detecting sensor reaches an entrance of the loop-shaped transport path, and the waiting paper sheet is transported in the loop-shaped transport path so that the front end edge thereof reaches the entrance of the loop-shaped transport path.
Figure 9:
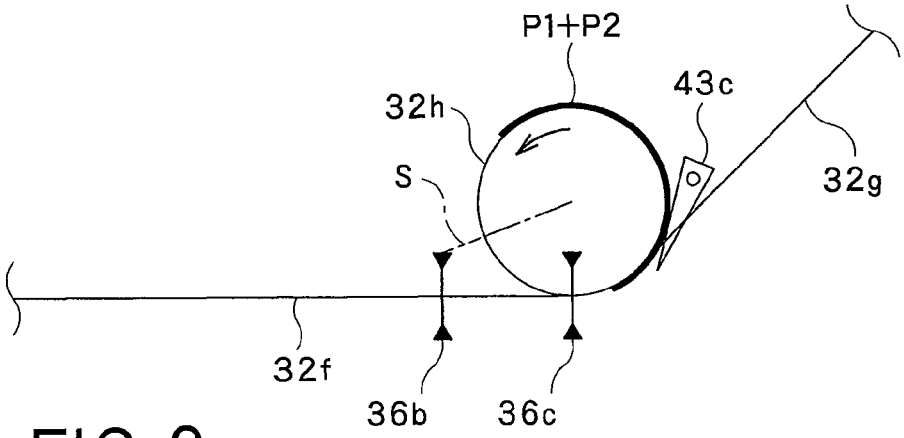
FIG. 9 is an explanatory view showing a state in which, after the state shown in FIG. 8, the paper sheet, which has been transported from the upstream side of the loop-shaped transport path to this transport path, and the paper sheet escrowed in the loop-shaped transport path, are merged to each other, and are further transported in the loop-shaped transport path.

At this time, the control unit 60 previously sets an acceleration and an acceleration period of the paper sheet P1 such that, when the front end edge of the paper sheet P2 is moved from the position of the paper-sheet detecting sensor 36*b* to reach the paper-sheet detecting sensor 36*c* disposed on the entrance of the loop portion of the transport path 32*h* (at a time point $t_1$ in FIG. 10), a front end edge of the paper sheet P1 is moved from the waiting position S to reach the paper-sheet detecting sensor 36*c*. In this manner, as shown in FIG. 8, the control unit 60 controls the stepping motors 45*c* and 45*d*, such that the front end edge of the paper sheet P1, which has been transported from the waiting position S, and the front end edge of the paper sheet P2, which has been detected by the paper sheet detecting sensor 36*b*, correspond to each other, at the position of the paper-sheet detecting sensor 36*c* disposed on the entrance of the loop portion of the transport path 32*h*. In addition, as shown in FIG. 10, at the position on which the paper-sheet detecting sensor 36*c* is disposed on the transport path 32*h*, the speed of the paper sheet P1, which has been transported from the waiting position S, and the speed of the paper sheet P2 which has been sent from the transport path 32*f* to the transport path 32*h*, respectively become V1, i.e., the speeds of the paper sheet P1 and the paper sheet P2 correspond to each other.

As shown in FIG. 8, under the state in which the front end edge of the paper sheet P1, which has been transported from the waiting position S, and the front end edge of the paper sheet P2, which has been sent from the transport path 32*f* to the transport path 32*h*, correspond to each other, the control unit 60 further rotates the transport belts 46*c* and 46*d* by the stepping motors 45*c* and 45*d*, so that the rotary body 34 is further rotated. Thus, the paper sheets P1 and P2 are merged or partly merged to each other, with their front end edges being aligned with each other, and are further transported in the transport path 32*h* at the speed V1 (constant speed). Then, when the merged or partly-merged paper sheets P1 and P2 are moved from the position of the paper-sheet detecting sensor 36*c* by a predetermined distance (at a time point $t_2$ in FIG. 10), the paper sheets P1 and P2 are further accelerated. More specifically, the rotary body 34 is accelerated from the speed V1 at a uniform acceleration speed. When the speed of the rotary body 34 reaches a speed V2 (e.g., 1300 mm/s) which is faster than the speed V1, the rotary body 34 is rotated uniformly at the speed V2. Thus, in the transport path 32*h*, both the paper sheets P1 and P2 are transported at the speed V2 (see FIG. 9).

When the paper sheets P1 and P2 are accelerated after having been partly merged to each other, a part on a rear end side of the paper sheet P2 which does not reach the transport path 32*h*, i.e., a part on the rear end side of the paper sheet P2, which still remains in the transport path 32*f*, is accelerated. As described above, although the roller 44*c* is rotated by the motor 45*b* at a constant speed in the transport path 32*f*, since the one-way clutch 45*p* is disposed between the roller 44*c* and the motor 45*b*, when a part on the rear end side of the paper sheet P2 which remains in the transport path 32*f* is accelerated, the roller 44*c* is released from the connection between the roller 44*c* and the motor 45*c*, so that the roller 44*c* is rotated at a speed corresponding to the speed of the paper sheet P2. Thus, since the one-way clutch 45*p* is disposed between the roller 44*c* and the motor 45*b*, after the paper sheets P1 and P2 have been partly merged to each other in the transport path 32*f* at a position on the upstream side relative to the loop-shaped transport path 32*h*, the paper sheet P2 can be transported at a speed faster than that of another paper sheet succeedingly transported from the upstream side in the transport path 32*f*. Namely, in the transport path 32*f*, after the paper sheets P1 and P2 have been partly merged to each other, a part on the rear end side of the paper sheet P2 can be transported at a speed faster than the speed of the transport belt 46*b* by the motor 45*b*.

Then, when the front end edges of the paper sheets P1 and P2 again come close to the waiting position S, the control unit 60 controls the speeds of the transport belts 46*c* and 46*d* by the stepping motors 45*c* and 45*d* such that the rotary body 34 is decelerated and is then stopped, when the front end edges of the paper sheets P1 and P2 reach the waiting position S. Thus, at a time point $t_3$ in FIG. 10, the front end edges of the paper sheets P1 and P2 are stopped at the waiting position S.

In this manner, when the light of the paper-sheet detecting sensor 36*b* is obstructed by the front end edge of the paper sheet P2, the control unit 60 controls the stepping motors 45*c* and 45*d*, such that the detected paper sheet P2 and the paper sheet P1, which is escrowed in the loop-shaped transport path 32*h*, are merged or partly merged to each other, with the front end edge of the detected paper sheet P2 and the front end edge of the escrowed paper sheet P1 corresponding to each other, and that the merged or partly-merged paper sheets P1 and P2 are transported to be escrowed in the loop-shaped transport path 32*h*. Thus, in the transport path 32*h*, it is possible to bundle various types of paper sheets of different lengths, with their front end edges being aligned to each other.

In the above description, there is explained an example in which the front end edges of the paper sheets P1 and P2 simultaneously reach the paper-sheet detecting sensor 36*c* disposed on the entrance of the loop portion of the transport path 32*h*. However, the following manner is also possible. Namely, when the front end edge of one paper sheet precedently reaches the loop portion of the transport path 32*h*, the precedent paper sheet is stopped to wait. Then, the other subsequent paper sheet is decelerated or stopped at the position of the paper-sheet detecting sensor 36*c*. Thereafter, the paper sheets are merged or partly merged and transported such that the front end edges thereof are aligned with each other. In either case, when the paper sheets P1 and P2 are merged or partly merged to each other, it is preferable that the paper sheets P1 and P2 are merged or partly merged with the speeds of the paper sheets P1 and P2 corresponding to each other. In addition, it is possible to control the motor 45*b* such that the transport speed of the paper sheet in the loop-shaped transport path 32*h* and the transport speed of the paper sheet in the transport path 32*f* are made to correspond to each other, without using the one-way clutch 45*p*.

Next, a method of aligning rear end edges of a plurality of paper sheets in the loop-shaped transport path 32*h* is described with reference to FIG. 11. Herein, there is explained a case in which paper sheets, which have been transported through the transport paths 32*a*, 32*d* and 32*f*, are sent to the transport path 32*h* in the paper-sheet stacking unit 30.

First, the transport belts 46*c* and 46*d* are stopped, so that the rotary body 34 is generally stopped. As shown in FIG. 11, a bundle of paper sheet(s) P1 in the loop-shaped transport path 32*h* is stopped such that a rear end edge thereof is located on a predetermined waiting position S. Under this state, a new paper sheet P2 is sent to the transport path 32*f* at a speed V1 (a constant speed). When a front end edge of the front end edge of the paper sheet P2 reaches the paper-sheet detecting sensor 36*a*, light of the paper-sheet detecting sensor 36*a* is obstructed, and when a rear end edge of the paper sheet P2 reaches the paper-sheet detecting sensor 36*a*, the light of the paper-sheet detecting sensor 36*a* again becomes unobstructed. Thus, based on the detection result by the paper-sheet detecting sensor 36*a*, an entire length (a distance from the front end edge to the rear end edge) of the paper sheet P2 in the transport direction can be calculated.

Figure 11:
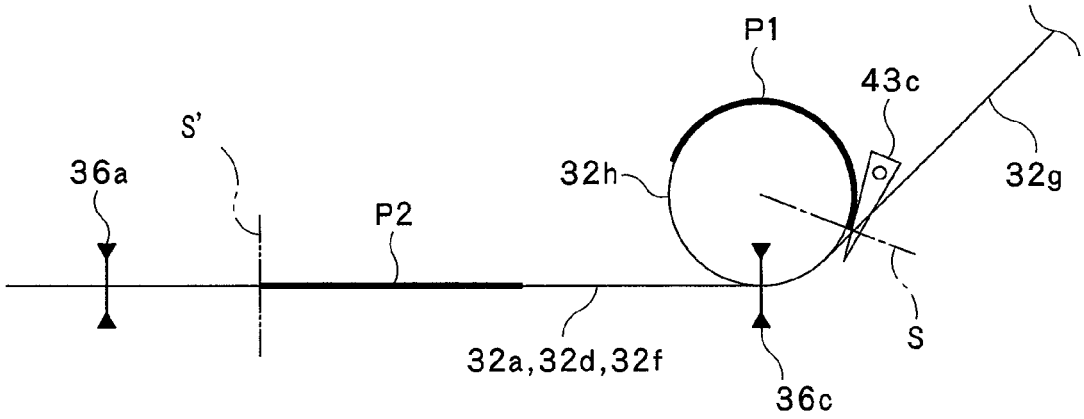
FIG. 11 is an explanatory view showing a state in the paper-sheet stacking unit of the paper-sheet handling apparatus shown in FIG. 1, in which, during an operation for aligning rear end edges of paper sheets, when a rear end edge of a paper-sheet bundle is located at the waiting position in the loop-shaped transport path, a rear end edge of a paper sheet reaches a predetermined position in the transport path on the upstream side relative to the loop-shaped transport path.

As shown in FIG. 11, in the transport path 32*a*, 32*d* or 32*f*, a predetermined position S' is previously set on the downstream side of the paper-sheet detecting sensor 36*a*. Thus, after a preset time period has passed from the detection of the rear end edge of the paper sheet P2 by the paper-sheet detecting sensor 36*a*, the rear end edge of the paper sheet P2 reaches the predetermined position S'. Then, when the rear end edge of the paper sheet P2 reaches the predetermined position S' on the downstream side of the paper-sheet detecting sensor 36*a*, the control unit 60 starts to move to circulate the transport belts 46*c* and 46*d* by the stepping motors 45*c* and 45*d*, so as to start to rotate the rotary body 34. At this time, the rotary body 34 is rotated at a uniform acceleration speed. When the speed of the rotary body 34 reaches the speed V1 of the paper sheet P2, the rotary body 34 is rotated uniformly at the speed V1. Thus, in the transport path 32*h*, the paper sheet P1 is transported at the speed V1.

At this time, the control unit 60 previously sets an acceleration speed and an acceleration period of the paper sheet P1 such that, when the rear end edge of the paper sheet P2 is moved from the predetermined position S' to reach the paper-sheet detecting sensor 36*c* disposed on the entrance of the loop portion of the transport path 32*h*, a rear end edge of the paper sheet P1 is moved from the waiting position S to reach the paper-sheet detecting sensor 36*c*. In this manner, the control unit 60 controls the stepping motors 45*c* and 45*d*, such that the rear end edge of the paper sheet P1, which has been transported from the waiting position S, and the rear end edge of the paper sheet P2, which has been transported from the predetermined position S', correspond to each other, at the position of the paper-sheet detecting sensor 36*c* disposed on the entrance of the loop portion of the transport path 32*h*. In addition, at the position on which the paper-sheet detecting sensor 36*c* is disposed on the transport path 32*h*, the speed of the paper sheet P1, which has been transported from the waiting position S, and the speed of the paper sheet P2, which has been transported from the predetermined position S', respectively become V1, i.e., the speeds of the paper sheet P1 and the paper sheet P2 correspond to each other.

Then, under the state in which the rear end edge of the paper sheet P1, which has been transported from the waiting position S, and the rear end edge of the paper sheet P2, which has been transported from the predetermined position S', correspond to each other, the control unit 60 further rotates the transport belts 46*c* and 46*d* by the stepping motors 45*c* and 45*d*, so that the rotary body 34 is further rotated. Thus, the paper sheets P1 and P2 are merged or partly merged to each other, with their rear end edges being aligned with each other, and are further transported in the transport path 32*h* at the speed V1 (constant speed). Then, when the merged or partly-merged paper sheets P1 and P2 are moved from the position of the paper-sheet detecting sensor 36*c* by a predetermined distance, the paper sheets P1 and P2 are further accelerated. More specifically, the rotary body 34 is accelerated from the speed V1 at a uniform acceleration speed. When the speed of the rotary body 34 reaches a speed V2 which is higher than the speed V1, the rotary body 34 is rotated uniformly at the speed V2. Thus, in the transport path 32*h*, both the paper sheets P1 and P2 are transported at the speed V2.

Then, when the rear end edges of the paper sheets P1 and P2 again come close to the waiting position S, the control unit 60 controls the speed of the transport belts 46*c* and 46*d* by the stepping motors 45*c* and 45*d*, such that the rotary body 34 is decelerated and is then stopped, when the rear end edges of the paper sheets P1 and P2 reach the waiting position S. Thus, the rear end edges of the paper sheets P1 and P2 are stopped at the waiting position S.

In this manner, when the rear end edge of the paper sheet P2 reaches the predetermined position S', the control unit 60 controls the stepping motors 45*c* and 45*d*, such that the paper sheet P2, which is sent from the upstream side of the transport path 32*h* to the transport path 32*h*, and the paper sheet P1, which is escrowed in the loop-shaped transport path 32*h*, are merged or partly merged to each other, with the rear end edge of the paper sheet P2 and the escrowed paper sheet P1 corresponding to each other, and that the merged or partly-merged paper sheets P1 and P2 are transported to be escrowed in the loop-shaped transport path 32*h*. Thus, in the transport path 32*h*, it is possible to bundle various types of paper sheets of different lengths, with their rear end edges being aligned to each other.

Figure 12:
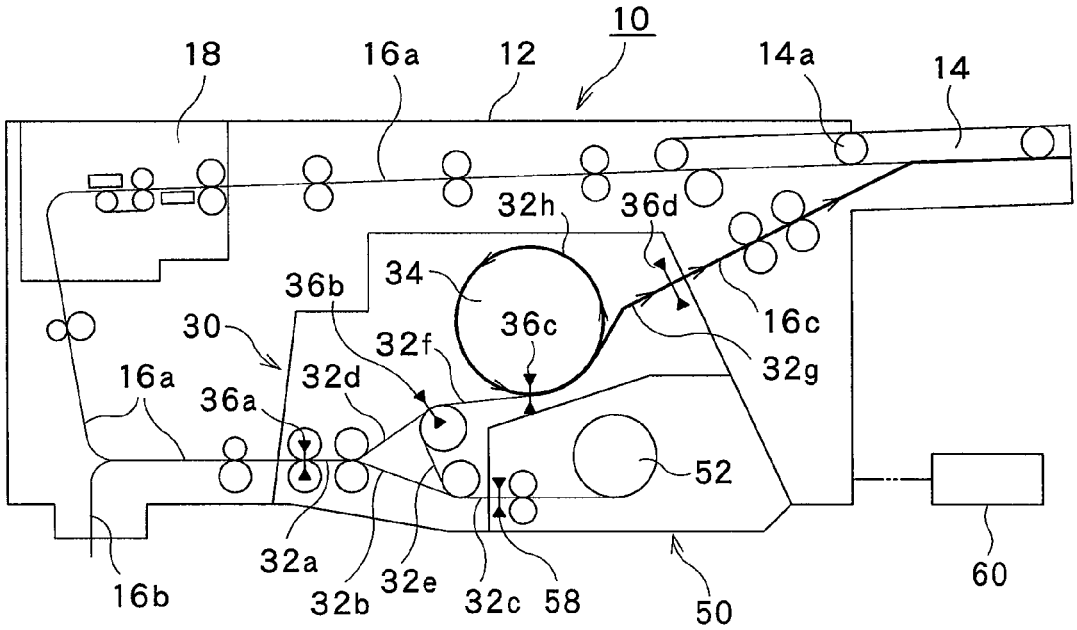
FIG. 12 is an explanatory view showing a paper-sheet route along which an escrowed paper sheet is returned to the outside of the apparatus, in the paper-sheet stacking unit of the paper-sheet handling apparatus shown in FIG. 1.

In the loop-shaped transport path 32*h* of the paper-sheet stacking unit 30, after a plurality of paper sheets have been escrowed in a bundle state with their designated portions (e.g., front end edges, rear end edges and so on of the paper sheets) in the transport direction being aligned with each other, the escrowed paper sheets in a bundle state are sent to the transport path 32*g* located on the downstream side of the transport path 32*h*. Specifically, when a command for discharging the paper-sheet bundle escrowed in the transport path 32*h* is given from, e.g., the higher-level apparatus or the like to the control unit 60, or when the paper sheets whose number is the predetermined number are escrowed in the transport path 32*h*, the control unit 60 controls the diverge member 43*c* such that the paper sheets escrowed in the transport path 32*h* are sent from the transport path 32*h* to the transport path 32*g*. As shown in FIG. 12, the paper-sheet bundle sent to the transport path 32*g* is returned from the transport unit 16*c* to the inlet 14. At this time, the paper sheets are retuned in a bundle state, with their designated portions in the transport direction being aligned with each other.

Figure 13:
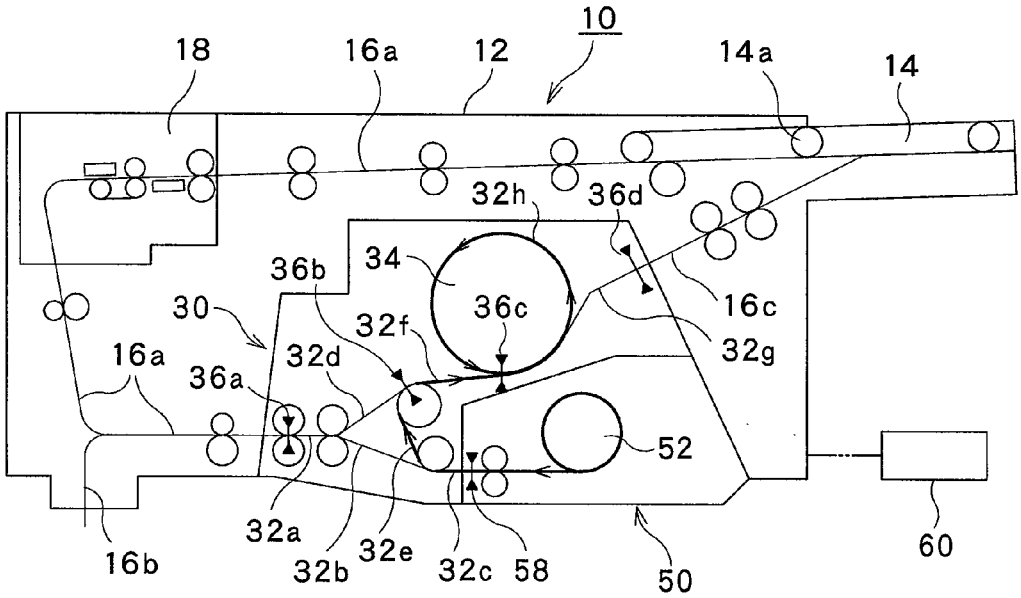
FIG. 13 is an explanatory view showing a paper-sheet route along which a paper sheet escrowed in the paper-sheet escrow unit is transported to the paper-sheet stacking unit, in the paper-sheet handling apparatus shown in FIG. 1.

Next, there is explained a case in which, in the paper-sheet handling apparatus 10, when a paper sheet(s) is escrowed in the paper-sheet escrow unit 50, a command for discharging the escrowed paper sheet is given by the higher-level apparatus or the like to the control unit 60, with reference to FIG. 13.

There is a case in which, when one or a plurality of paper sheets are wound on the winding roller 52 of the paper-sheet escrow unit 50 so as to be escrowed, the higher-level apparatus or the like gives a command for discharging the escrowed paper sheet(s) to the control unit 60. At this time, the paper sheet escrowed in the paper-sheet escrow unit 50 is returned to the inlet 14 through the paper-sheet stacking unit 30. To be specific, the control unit 60 controls the diverge member 43*b* such that the paper sheet is sent, one by one, from the paper-sheet escrow unit 50 to the loop-shaped transport path 32*h* through the transport paths 32*c*, 32*e* and 32*f* in this order (see FIG. 13).

The paper sheet, which has been sent to the loop-shaped transport path 32*h*, is escrowed in a bundle state in the transport path 32*h*. At this time, the control unit 60 controls the diverge member 43*c* such that the paper sheet escrowed in the transport path 32*h* is not sent from the transport path 32*h* to the transport path 32*g*. In this manner, since the paper sheets escrowed in the paper-sheet escrow unit 50 are sent one after another to the loop-shaped transport path 32*h* of the paper-sheet stacking unit 30, the plurality of paper sheets are escrowed in a bundle state in the transport path 32*h*. Thereafter, when all the paper sheets escrowed in the paper-sheet escrow unit 50 are sent to the paper-sheet stacking unit 30, similarly to the case described with reference to FIG. 12, the control unit 60 controls the diverge member 43*c* such that the paper sheets escrowed in the transport path 32*h* are sent from the transport path 32*h* to the transport path 32*g*. As shown in FIG. 12, the paper-sheet bundle sent to the transport path 32*g* is returned from the transport unit 16*c* to the inlet 14. At this time, the paper sheets are returned in a bundle state, with their designated portions in the transport direction being aligned to each other.

As described above, according to the paper-sheet handling apparatus 10 in this embodiment, the paper-sheet stacking unit 30 is provided with the loop portion formed of the loop-shaped transport path 32*h* which is capable of transporting and escrowing a bundle of paper sheet(s) P1. In the transport path 32*f* at a position on the upstream side relative to the loop portion, there is provided the paper-sheet detecting sensor 36*b* configured to detect a paper sheet P2 to be transported to the loop portion. When the paper-sheet detecting sensor 36*b* detects the paper sheet P2, the detected paper sheet P2 and the escrowed bundle of paper sheets P1 are merged to each other, such that a designated portion of the detected paper sheet P2 and a designated portion of the bundle of paper sheets P1 escrowed in the loop portion correspond to each other, and the merged paper sheets P1 and P2 are transported and escrowed in the loop portion. In addition, in the paper-sheet handling apparatus 10 in this embodiment, as shown in FIG. 10, after the detected paper sheet P2 and the escrowed bundle of paper sheets P1 have been merged or partly merged to each other, the control unit 60 controls the stepping motors 45*c* and 45*d* such that the merged or partly-merged paper sheets P1 and P2 are accelerated in at least the loop portion.

In this manner, when the paper-sheet bundle is transported to be escrowed in the loop portion (loop-shaped transport path 32*h*), after a paper sheet P2, which has been sent from an upstream side of the loop portion to the loop portion, and an escrowed paper sheet P1 have been merged or partly merged to each other, the merged or partly-merged paper sheets P1 and P2 are accelerated in at least the loop portion. Thus, even when the paper sheet P2 is transported to the loop portion at a pitch smaller than a length of the loop portion, i.e., a peripheral length of the transport path 32*h*, the paper sheet P1 can be escrowed in the loop portion such that designated portions (e.g., front end edges, rear end edges and so on) of the paper sheets P1 and P2 have a predetermined positional relationship.

In particular, according to the paper-sheet handling apparatus 10 in this embodiment, in the paper-sheet stacking unit 30, as shown in FIG. 10, the control unit 60 controls the stepping motors 45*c* and 45*d* such that, after the detected paper sheet P2 and the escrowed bundle of paper sheets P1 have been merged or partly merged to each other, the merged or partly-merged paper sheets are accelerated in the loop portion, and that, when the speed of the paper sheets reaches a preset predetermined speed V2, the paper sheets are transported at the predetermined speed V2 and are then decelerated. In addition, after the detected paper sheet P2 and the escrowed bundle of paper sheets P1 had been merged or partly merged to each other, the control unit 60 controls the stepping motors 45*c* and 45*d* such that, after the merged or partly-merged paper sheets P1 and P2 have been transported by a preset predetermined distance in the loop portion (see FIG. 10), the paper sheets P1 and P2 are accelerated.

In addition, in the paper-sheet handling apparatus 10 in this embodiment, in the paper-sheet stacking unit 30, the loop-shaped transport unit 32*h* is provided with the movable width adjusting members 48 and 49 for adjusting the width of the transport path 32*h*. The width adjusting members 48 and 49 are configured to vary the width of the transport path 32*h*, based on the number of paper sheets escrowed in the loop-shaped transport path 32*h*. Since the width of the loop-shaped transport path 32*h* can be varied by the movable width adjusting members 48*a* and 49 in accordance with a thickness of the paper-sheet bundle, a position through which the paper-sheet bundle transported in the transport path 32*h* passes can be restricted. Accordingly, it can be restrained that, while the paper-sheet bundle is transported in the loop-shaped transport path 32*h*, an innermost paper sheet and an outermost paper sheet are displaced from each other, by a difference between an inner peripheral speed and an outer peripheral speed.

In addition, in the paper-sheet handling apparatus 10 in this embodiment, in the paper-sheet stacking unit 30, the one-way clutch 45*p* is disposed between the roller 44*c* and the motor 45*b*. Thus, in the transport path 32*f* at a position on the upstream side relative to the loop-shaped transport path 32*h*, after the detected paper sheet P2 and the escrowed bundle of the paper sheets P1 have been partly merged to each other, the partly-merged paper sheet P2 can be transported faster than another paper sheet that is succeedingly transported from the upstream side in the transport path 32*f*.

The operation of the paper-sheet handling apparatus 10 of the present invention, in particular, the operation of the paper-sheet stacking unit 30 is not limited to the aforementioned embodiment, and can be variously modified.

For example, a paper sheet P2, which is transported from the transport path 32*f* to the transport path 32*h*, and paper sheets P1 in a bundle state, which are escrowed in the transport path 32*h*, can be merged to each other, with a designated portion of the paper sheet P2 and a designated portion of the paper sheets P1 being displaced from each other by a predetermined amount (e.g., about several millimeters). The predetermined amount may be an absolute value, or a length of a predetermined ratio relative to the entire length of the paper sheet in the transport direction.

In addition, after the detected paper sheet P2 and the escrowed bundle of paper sheets P1 have been merged or partly merged to each other and the merged or partly-merged paper sheets P1 and P2 have been transported by a preset predetermined period of time in the loop portion, the paper sheets P2 and P2 may be accelerated.

In addition, after the detected paper sheet P2 and the escrowed bundle of paper sheets P1 have been merged or partly merged to each other, the merged or partly-merged paper sheets P1 and P2 may be accelerated immediately thereafter.

In addition, after the detected paper sheet P2 and the escrowed bundle of paper sheets P1 have been merged or partly merged to each other and the rear end edge of the paper sheet P2, which has been transported from the transport path 32*f* to the transport path 32*h*, has passed through a preset predetermined position, the merged or partly-merged paper sheets P1 and P2 may be accelerated. Specifically, the roller 44*p* is provided with a paper-sheet detecting sensor (not shown) configured to detect whether a paper sheet is in contact with the roller 44*p* or not. In the transport of a paper sheet from the paper-sheet escrow unit 50 to the loop-shaped transport path 32*h* through the transport paths 32*c*, 32*e* and 32*f* of the paper-sheet stacking unit 30, even when the bundle of paper sheets P1 and the paper sheet P2 are merged or partly merged to each other, the merged or partly-merged paper sheets P1 and P2 are not accelerated, as long as the fact that a part of the rear end edge of the paper sheet P2 is in contact with the roller 44*p* is detected by the above paper-sheet detecting sensor. Thereafter, when this paper sheet P2 is further transported and the rear end edge of the paper sheet P2 is separated from the roller 44*p*, the paper-sheet detecting sensor detects that the paper sheet P2 is not in contact with the roller 44*p*. Upon this detection, the merged or partly-merged paper sheets P1 and P2 are accelerated.

In addition, in the paper-sheet stacking unit 30, the number of the paper sheet(s) P2 to be transported from the transport path 32*f* to the transport path 32*h* is not limited to one. Namely, a plurality of paper sheets in a bundle state may be sent from the transport path 32*f* to the transport path 32*h*. After the bundle of paper sheets has been merged to a bundle of paper sheet(s) which has been already escrowed in the transport path 32*h*, the bundle of paper sheets may be escrowed in the transport path 32*h*.

In addition, similarly to Patent Document 1, even when the number of transport paths connected to the loop-shaped transport path 32*h* is one, the operation for merging paper sheets can be carried out in the same manner as the aforementioned embodiment.

Next, a modified example of the paper-sheet stacking unit 30 in the paper-sheet handling apparatus 10 in this embodiment is described with reference to FIG. 14.

In the paper-sheet stacking unit 30 of the paper-sheet handling apparatus 10 in this embodiment, the transport belts 46*c* and 46*d* are wound on a part of the outer peripheral surface of the rotary body 34 from the up and down directions, and a paper-sheet bundle is transported between the outer peripheral surface of the rotary body 34 and the transport belts 46*c* and 46*d*. In order to restrain that, while the paper-sheet bundle is transported in the loop-shaped transport path 32*h*, an innermost paper sheet and an outermost paper sheet are displaced from each other, by a difference between an inner peripheral speed and an outer peripheral speed, it is desired that an angular speed of each of the transport belts 46*c* and 46*d* and an angular speed of the rotary body 34 are equal to each other. In order to make equal the angular speed of the respective transport belts 46*c* and 46*d* and the angular speed of the rotary body 34, it is necessary to decrease a circumferential speed of the outer peripheral surface of the rotary body 34, relative to a moving speed of the respective transport belts 46*c* and 46*d*, by a thickness of a paper-sheet bundle. However, in a case where a length of a paper sheet, which is transported in the loop-shaped transport path 32*h*, is short in the transport direction, when a paper-sheet bundle is transported between the lower transport belt 46*c* and the rotary body 34, the rotary body 34 is rotated integrally with the upper transport belt 46*d*, by a frictional force acting between the outer peripheral surface of the rotary body 34 and the upper transport belt 46*d*, so that the circumferential speed of the outer peripheral surface of the rotary body 34 become synchronized with the moving speed of the transport belt 46*d*. In this case, the angular seed of the upper transport belt 46*d* and the angular speed of the rotary body 34 do not correspond to each other, whereby displacement of paper sheets in a bundle might occur in the loop-shaped transport path 32*h*.

Figure 14:
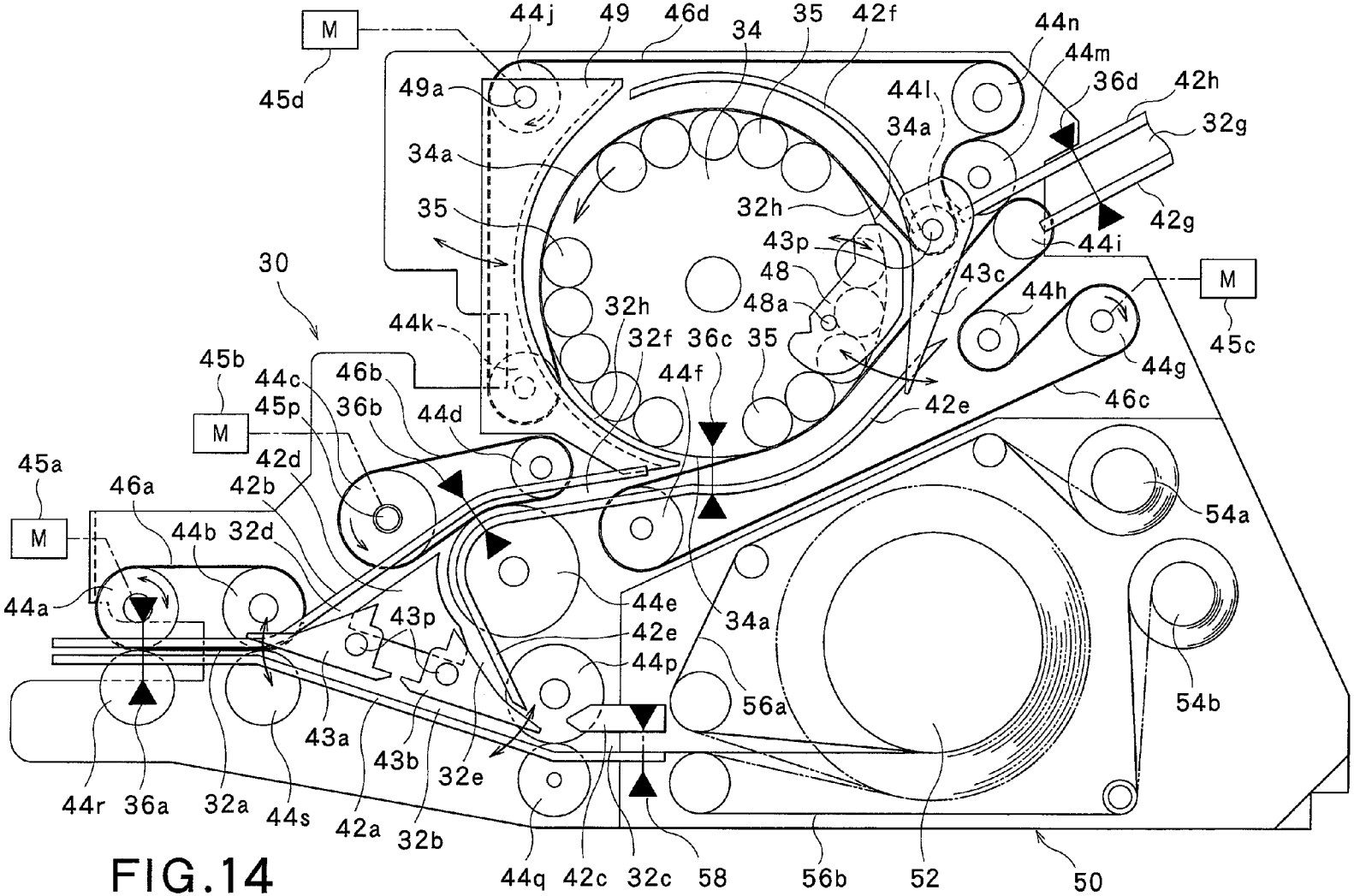
FIG. 14 is a structural view showing another structure of the paper-sheet stacking unit of the paper-sheet handling apparatus in this embodiment.
Figure 15:
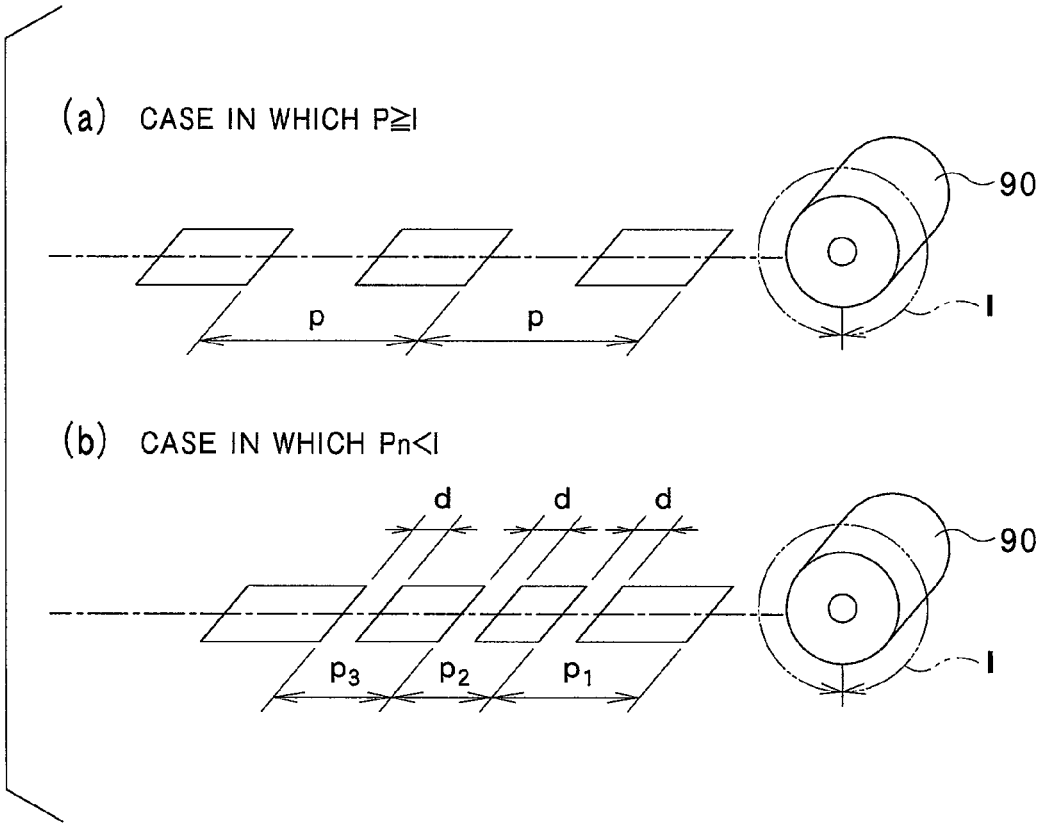
FIGS. 15(*a*) and 15(*b*) are explanatory views showing an operation for sequentially sending a plurality of paper sheets of various lengths to a rotary body, in a conventional paper-sheet handling apparatus.

In order to solve this problem, in the paper-sheet stacking unit 30 according to the modified example shown in FIG. 14, a plurality of rollers 35 are rotatably arranged on the rotatable cylindrical rotary body 34 along the outer peripheral surface of the rotary body 34. In more detail, at each of three positions of the outer peripheral surface of the rotary body 34, the five rollers 35 are disposed in a row. Namely, the fifteen rollers 35 in total are arranged along the outer peripheral surface of the rotary body 34. Each of the rollers 35 is configured to be integrally rotated with the rotary body 34 about a shaft of the rotary body 34, when the rotary body 34 is rotated.

An outer peripheral surface 34*a* of the rotary body 34 is formed between one roller group including the five rollers 35 and another roller group. In an area between one roller group and another roller group, the transport belts 46*c* and 46*d* are in contact with the outer peripheral surface 34*a* of the rotary body 34. On the other hand, at the position on which each of the roller groups is disposed, the transport belts 46*c* and 46*d* are in contact with the respective rollers 35.

According to the paper-sheet stacking unit 30 in the modified example shown in FIG. 14, due to the provision of the plurality of rollers 35 along the outer peripheral surface of the rotary body 34, even when a length of a paper sheet, which is transported in the loop-shaped transport path 32*h*, is short in the transport direction, in the transport of a bundle of such paper sheets between the lower transport belt 46*c* and the rotary body 34, the upper transport belt 46*d* is in contact with the respective rotatable rollers 35 so that the rotary body 34 is not rotated integrally with the upper transport belt 46*d*. Thus, the circumferential speed of the outer peripheral surface of the rotary body 34 can be prevented from being synchronized with the speed of the transport belt 46*d*, whereby displacement of the paper sheets in the bundle can be prevented in the loop-shaped transport path 32*h*. In addition, in the area between one roller group and another roller group, the transport belts 46*c* and 46*d* are in contact with the outer peripheral surface 34*a* of the rotary body 34. Thus, in the area between one roller group and another roller group, a paper sheet can be gripped by a frictional force acting between the outer peripheral surface 34*a* of the rotary body 34 and the paper sheet, whereby it is possible to prevent slippery of an inside paper sheet in the paper-sheet bundle that is transported in the loop-shaped transport path 32*h*.

The invention claimed is:

1. A paper-sheet handling apparatus comprising:

a transport path of a paper sheet, including a loop portion capable of transporting and escrowing a bundle of paper sheet(s);

a detecting unit located on the transport path at a position on an upstream side relative to the loop portion, the detecting unit being configured to detect at least one paper sheet to be transported to the loop portion;

a drive unit configured to transport a paper sheet in the transport path, such that a paper sheet in the loop portion and a paper sheet in another part of the transport path are transported independently from each other or in synch with each other; and a control unit configured to control the drive unit in such a manner that when the detecting unit detects at least the one paper sheet, the detected paper sheet and a bundle of paper sheet(s) escrowed in the loop portion are merged to each other, such that a designated portion of the detected paper sheet and a designated portion of the escrowed bundle of paper sheet have a predetermined positional relationship, and that the merged paper sheets are escrowed in the loop portion;

wherein the control unit is configured to control the drive unit such that the detected paper sheet and the escrowed bundle of paper sheet are merged or partly merged to each other at a constant speed, whereupon the merged or partly-merged paper sheets are accelerated further from the constant speed in at least the loop portion.

2. The paper-sheet handling apparatus according to claim 1, wherein the control unit is configured to control the drive unit such that after the detected paper sheet and the escrowed bundle of paper sheet have been merged or partly merged to each other at the constant speed and the merged or partly-merged paper sheets have been transported by a predetermined distance in the loop portion at the constant speed, these paper sheets are accelerated further from the constant speed.

3. The paper-sheet handling apparatus according to claim 1, wherein the control unit is configured to control the drive unit such that after the detected paper sheet and the escrowed bundle of paper sheet have been merged or partly merged to each other at the constant speed and the rear end edge of the paper sheet that has been sent from the upstream side relative to the loop portion to the loop portion passes through a preset predetermined position at the constant speed, the merged or partly-merged paper sheets are accelerated further from the constant speed.

4. The paper-sheet handling apparatus according to claim 1, wherein the control unit is configured to control the drive unit such that after the detected paper sheet and the escrowed bundle of paper sheet have been merged or partly merged to each other at the constant speed, the merged or partly-merged paper sheets are accelerated further from the constant speed in the loop portion, and that when a speed of the merged or partly-merged paper sheets reaches a preset predetermined speed, the merged or partly-merged paper sheets are transported at this predetermined speed and are then decelerated.

5. The paper-sheet handling apparatus according to claim 1, wherein the loop portion of the transport path is provided with a movable width adjusting mechanism configured to adjust a width of the loop portion, and the width adjusting mechanism is configured to vary the width of the loop portion, based on the number of paper sheet(s) escrowed in the loop portion.

6. The paper-sheet handling apparatus according to claim 1, wherein, after the detected paper sheet and the escrowed bundle of paper sheet have been partly merged to each other at the constant speed, when the partly-merged paper sheets are accelerated further from the constant speed in the loop portion, a part on a rear end side of the detected paper sheet that does not reach the loop portion is pulled by a front end side of the detected paper sheet, and thus is accelerated.

7. The paper-sheet handling apparatus according to claim 6, wherein a roller configured to transport a paper sheet and a motor configured to drive the roller are disposed in the transport path at a position on the upstream side relative to the loop portion, while a one-way clutch is disposed between the motor and the roller, and when the partly-merged paper sheets are accelerated in the loop portion, the part on the rear end side of the detected paper sheet that does not reach the loop portion is accelerated by releasing the roller from a connection between the roller and the motor by means of the one-way clutch.

8. The paper-sheet handling apparatus according to claim 1, further comprising:

a cylindrical rotary body that is rotatably disposed;

a transport belt that is in contact with at least a part of an outer peripheral surface of the rotary body; and a motor configured to drive the transport belt;

wherein at least a part of the loop portion of the transport path is formed between the rotary body and the transport belt.

9. The paper-sheet handling apparatus according to claim 8, wherein the rotary body is provided with a plurality of rollers along the outer peripheral surface of the rotary body, and in the loop portion of the transport path, the transport belt is configured to be in contact with either one of the respective rollers and the outer peripheral surface of the rotary body.

10. The paper-sheet handling apparatus according to claim 9, wherein the outer peripheral surface of the rotary body is formed between one roller group including the plurality of rollers in a row and another roller group, in an area between one roller group and another roller group, the transport belt is configured to be in contact with the outer peripheral surface of the rotary body, and at a position on which each of the roller groups is disposed, the transport belt is configured to be in contact with the respective rollers.

11. A paper-sheet handling method comprising:

transporting at least one paper sheet, at a position on an upstream side relative to a loop portion of a transport path, toward the loop portion;

detecting at least one paper sheet by a detecting unit located on the transport path at a position on the upstream side relative to the loop portion;

transporting and escrowing a bundle of paper sheet(s) in the loop portion of the transport path;

merging at least the one paper sheet detected by the detecting unit, to the bundle of paper sheet escrowed in the loop portion of the transport path; and discharging the bundle of paper sheets escrowed in the loop portion to the transport path;

wherein:

after the detecting unit has detected at least the one paper sheet, the detected paper sheet and the bundle of paper sheet escrowed in the loop portion are merged to each other, such that a designated portion of the detected paper sheet and a designated portion of the escrowed bundle of paper sheet have a predetermined positional relationship, and the merged paper sheets are escrowed in the loop portion; and after the detected paper sheet and the escrowed bundle of paper sheet have been merged or partly merged to each other at a constant speed, the merged or partly-merged paper sheets are accelerated further from the constant speed in at least the loop portion.

* * * * *